US008689674B2

(12) United States Patent
Duke et al.

(10) Patent No.: US 8,689,674 B2
(45) Date of Patent: Apr. 8, 2014

(54) AXIAL PISTON MACHINE WITH ROTATION RESTRAINT MECHANISM

(75) Inventors: Noel Stephen Duke, Pukekohe (NZ); Robert Gulliver Lynn, Ashburton (NZ)

(73) Assignee: Duke Engines Limited, Auckland (NZ)

( * ) Notice: Subject to any disclaimer, the term of this patent is extended or adjusted under 35 U.S.C. 154(b) by 970 days.

(21) Appl. No.: 12/733,133

(22) PCT Filed: Aug. 8, 2008

(86) PCT No.: PCT/NZ2008/000202

§ 371 (c)(1),
(2), (4) Date: May 11, 2010

(87) PCT Pub. No.: WO2009/022917

PCT Pub. Date: Feb. 19, 2009

(65) Prior Publication Data

US 2010/0236400 A1 Sep. 23, 2010

Related U.S. Application Data

(60) Provisional application No. 60/935,409, filed on Aug. 10, 2007.

(30) Foreign Application Priority Data

Aug. 10, 2007 (NZ) ..... 560589

(51) Int. Cl.
*F01B 13/04* (2006.01)
*F16H 23/00* (2006.01)

(52) U.S. Cl.
USPC ..... 92/12.2; 92/57; 91/499; 74/60

(58) Field of Classification Search
USPC ..... 92/12.2, 57, 71; 91/499; 417/269; 74/60, 591
See application file for complete search history.

(56) References Cited

U.S. PATENT DOCUMENTS

| | | | | |
|---|---|---|---|---|
| 1,948,827 A | | 2/1934 | Redrup | |
| 2,240,912 A | * | 5/1941 | Porter | 74/60 |
| 3,654,906 A | | 4/1972 | Airas | |

(Continued)

FOREIGN PATENT DOCUMENTS

| | | |
|---|---|---|
| GB | 884585 | 12/1961 |
| SU | 1643757 | 4/1991 |

*Primary Examiner* — Michael Leslie
(74) *Attorney, Agent, or Firm* — Jacobson Holman PLLC

(57) ABSTRACT

A reciprocator restraint assembly for a Z-crank axial piston machine is described. The assembly includes two gimbal arms each linked together at gimbal link joint that intersect at a point T. Point T lying in a medial plane M being defined as the plane passing through the point of coincidence of the crank and crankshaft axes to which the line that bisects the crank angle is normal. Each of the gimbal arms is pivotally mounted at an identical distance L from point T. A cylinder gimbal is pivotally mounted from the cylinder cluster and a reciprocator gimbal is pivotally mounted from the reciprocator. The reciprocator gimbal pivot axis is equidistant from point X and T as is the cylinder gimbal pivot axis. The orientations of the pivot axes of the two gimbal arms being mutual reflections in the medial plane M resulting in the point T lying on the medial plane M as the crankshaft rotates with respect to the cylinder cluster, and thus ensuring homo-kinetic rotational restraint between the reciprocator and the cylinder cluster.

82 Claims, 9 Drawing Sheets

(56) References Cited

U.S. PATENT DOCUMENTS

| | | | |
|---|---|---|---|
| 3,939,809 | A | 2/1976 | Rohs |
| 4,235,116 | A | 11/1980 | Meijer |
| 4,491,057 | A | 1/1985 | Ziegler |
| 4,852,418 | A | 8/1989 | Armstrong |
| 5,094,195 | A | 3/1992 | Gonzalez |
| 5,129,752 | A | 7/1992 | Ebbing |
| 5,450,823 | A | 9/1995 | Istomin |
| 6,003,480 | A | 12/1999 | Quayle |

* cited by examiner

AXIAL PISTON MACHINE WITH ROTATION RESTRAINT MECHANISM

This is a national stage of PCT/NZ08/000,202 filed Aug. 8, 2008 and published in English, which has a priority of New Zealand no. 560589 filed Aug. 10, 2007 and claiming benefit of U.S. provisional application No. 60/935,409, filed Aug. 10, 2007, hereby incorporated by reference.

FIELD OF INVENTION

This invention relates to a rotation restraint mechanism in or for axial piston machines, including but not limited to thermodynamic engines and fluid pumps and to such engines and pumps that include a rotation restraint mechanism.

In particular, although not solely, this invention relates to rotation restraint mechanisms for Z-crank axial piston machines such as two or four-stroke axial piston internal combustion engines and pumps in general.

BACKGROUND

An axial piston machine is a machine in which a plurality of axially extending cylinders, together comprising the cylinder cluster, is arranged in a generally rotationally symmetrical layout around a central axis coincident with the rotational axis of a crankshaft. Each cylinder contains a reciprocating piston and may reciprocate along an axis parallel or slightly inclined to that of the other cylinders. Axial piston machines may offer a number of potential advantages over other multi-cylinder piston machine configurations including: reductions in size and weight, simplified fluid porting, and the ability to achieve close to perfect balancing of the dynamic inertial forces.

There are a number of different mechanisms that can be used to drive the reciprocating motion of the pistons in their cylinders, two of the most common types being Swashplate drives and Z-Crank drives. While terminology can vary, a swashplate is in effect a cam surface attached to and rotating with the crankshaft that drives or is driven by the reciprocating linear motion of the pistons. Each piston has a bearing or bearings attached to it that slides or rolls over the surface of the swashplate cam surface. Each piston also has some form of linear bearing such as the side of the piston within its cylinder that reacts the lateral forces created by the action of the piston-driving bearings when on the inclined surface of the swashplate. The piston-swashplate bearings may have a sliding or rolling speed over the swashplate in the order of two times the peak piston speed. While this arrangement is adequate for axial piston machines having relatively low piston speeds such as compressors and hydraulic pumps or motors, modern internal combustion engines commonly have much higher piston speeds. Also inertial loads and bearing sliding or rolling speeds in a swashplate drive operating can lead to high frictional losses for the higher speed combustion engines making standard swashplate configurations less attractive for internal combustion engines.

Z-Crank drives employ an intermediate body known variously as a Wobbleplate, Wabbler, Reciprocator or Spider that rotates on reciprocator bearings. Such is mounted on and for rotation about a crank section of the crankshaft by reciprocator bearings. The inclined crank section has an inclined crank axis that is at an acute angle (hereinafter referred to as the "swash angle"), to and intersecting with the crankshaft's rotational axis. The intersection point is hereinafter referred to as "point X".

The reciprocator is restrained against rotation relative to the cylinder cluster. Rotation of the inclined crank section by rotation of the crankshaft causes the reciprocator to nutate. As a result, points on the body of the reciprocator in a plane passing through point X and perpendicular to the crank axis, move in a predominantly axial oscillatory motion parallel to the crank shaft axis, with motion in the plane perpendicular to the crankshaft axis being of relatively small magnitude. Such points define the preferred location for engaging connection rods for the transmission of motion between a piston and the reciprocator.

The connection between the reciprocator and pistons can take many forms but generally connection rods, having sufficient rotational degrees of freedom at either end are utilised. The reciprocator bearings typically operate at much lower sliding speeds than would the swash plate piston bearings of an equivalent Swashplate drive. As a consequence frictional losses will generally be reduced and higher operating speeds may be made possible.

An important element of an axial piston machine design incorporating a Z-crank drive is the method used to restrain the reciprocator from rotation relative to the cylinder cluster (herein after referred to as the method of "rotation restraint"). Without such a restraint the reciprocator will generally not translate the rotation of the crankshaft into the necessary reciprocating motion of the pistons as desired. Depending on swash angle, the rotation restraint arrangement generally transmits a rotation similar in magnitude to the rotation delivered (or absorbed in the case of a pump or compressor) by the crankshaft.

A number of rotation restraint systems that have been employed.

U.S. Pat. No. 4,491,057 utilises a Universal joint, also known as a Cardan or Hooke's joint, to provide the rotation restraint for the reciprocator. The Universal joint is not a constant-velocity joint and as the crankshaft rotates the reciprocator is subjected to gimbal error that produces unbalanced angular accelerations and inertial rotations at twice the frequency of the crankshaft rotation. These accelerations and rotations increase greatly if the swash angle is increased and also become more pronounced at high speeds. The gimbal error has a period of 180 degrees of rotation of the cranks shaft relative to the reciprocator. So that for connection rods connected at other than 180 degree spacings about the cranks axis (i.e. of an axial piston machine with two pistons), the reciprocating motion of the pistons in their cylinders varies such that different pistons will not share the same displacement, velocity and acceleration cycles. The variation in fluid and thermodynamic processes between cylinders that this can lead to is generally undesirable. Therefore Cardan joints do not readily lend themselves to use in machines with odd numbers of pistons.

Another system that has been employed such as described in U.S. Pat. No. 6,003,480 or U.S. Pat. No. 4,852,418 uses a planar sliding guide, groove or cam surface attached to the cylinder cluster against which a complementary bearing attached to the reciprocator runs in order to provide reciprocator rotation restraint. Because the motion of the bearing on the reciprocator is held planar with respect to the cylinder cluster, the pistons in a Z-crank machine employing such a sliding rotation restraint system may be subjected to similar variations in the motions of the pistons as with universal joint rotation restraint systems. There may also be significant frictional losses associated with such a sliding rotation restraint system owing to the relatively high sliding velocities at the rotation restraint bearing contact point.

U.S. Pat. No. 5,094,195 utilises meshing bevel gears in which a reciprocator mounted bevel gear concentric to the reciprocator axis with the vertex of its conical teeth coincident with point X engages with a second identical bevel gear mounted off of the cylinder cluster concentric to the axis of the crankshaft with the vertex of its conical teeth also coincident with point X. The two bevel gears have the same number of teeth and the same cone angle equal to 180 degrees minus the swash angle. This bevel gear rotation restraint method has a number of possible disadvantages:

- The bevel gear mounted on the reciprocator can add significantly to the mass of the reciprocator and contribute to higher inertial loadings on the reciprocator bearings.
- The bevel gears engage at high speed and can be the source of significant frictional losses.
- Bevel gears subjected to the pulsating rotations generated by internal combustion or gas compression can also be subjected to significant impulsive loads that may require heavier gears and can also generate significant noise as a result of backlash.
- Bevel gears generally requite precise alignment to run quietly and efficiently without wear, and this can be difficult to achieve within the highly loaded dynamic environment of the reciprocator.
- Bevel gears are generally limited to operating at one fixed swash angle.
- Space and geometrical restraints can make it difficult to build sufficiently robust bevel gears into the machine given the necessity placement of other components and the rotation transmitted. Placing suitable bevel gears in the required locations about point X could also compromise the design of the reciprocator, the conical face of the bevel gears generally needs to lie either radially inside or outside of the circular array of connecting rods, the inner radial location can lead to structural compromises in design that may increase reciprocator mass and reciprocator bearing frictional losses. The outer radial location for a bevel gear on the reciprocator may have generally fewer structural compromises, but may increase the overall diameter of the engine significantly. A large diameter bevel gear on the periphery of the reciprocator will generally introduce a lot of reciprocating mass with consequently higher reciprocator bearing loads. Higher pitch-line-engagement velocities for large diameter bevel gears peripheral to the reciprocator and conrods may lead to unacceptable noise, friction and wear.

U.S. Pat. No. 5,450,823 employs a homo-kinetic or Constant Velocity (CV) type joint in the form of a double Universal joint, incorporating two Universal joints connected together through a short intermediate shaft such that the gimbal error from each joint is cancelled out by the other. There is a significant degree of complexity and a large number of bearings involved in the arrangement and the required placement of this rotation restraint mechanism may also make the reciprocator heavier due to the less ideal load paths in the reciprocator that is built around it.

Another solution that has been suggested for rotation restraint in U.S. Pat. No. 5,129,752 is to employ Ball-and-Crevice or Rzeppa type constant velocity (CV) joints as are commonly used to drive the front wheels of cars. In most CV applications the balls in such a joint orbit in a circular path. They hence have inertial forces that are principally centrifugal and are reacted by the enclosing housing with little friction, but in a Z-crank machine the balls are continuously accelerated back and forth in harmonic motion along an arcuate path. These alternating accelerations and decelerations at the relatively high speeds of an axial piston internal combustion engine in combination with impulsive and even reversing rotation loads may lead to excessive friction and wear.

U.S. Pat. No. 1,948,827 utilises a rotation arm mounted pivotally off of the reciprocator with a pivot axis perpendicular to the reciprocator axis passing through point X. The tip of this rotation arm is linked through a short connecting rod to an eccentric shaft rotating at twice the speed of the crankshaft. This produces a rotation restraint system that is closer to ideal than a universal joint. This mechanism also has extra complexity due to the auxiliary shaft that must be indexed to the crankshaft rotation at twice its speed. Such a rotation restraint method may be even more difficult to incorporate within an axial piston machine in which the cylinder cluster is spinning such as described in U.S. Pat. No. 3,654,906 (Airas).

U.S. Pat. No. 4,235,116 shown in FIG. 1 and FIG. 2, describes a rotation restraint method that utilises two restraint gimbals 60, 70. The two gimbals are linked together at a point 64.

U.S. Pat. No. 4,235,116 suggests that the link 64 between the two gimbals 60, 70 should consist of a ball joint or universal joint. However ball joints are generally not suited to high speed reciprocating motion under high-load conditions. Such conditions can lead to rapid wear and short life. This may be further exacerbated by the high swash angle and hence larger range of ball joint motion. Utilising a conventional universal joint having two perpendicular rotational degrees of freedom at point 64 (such as are commonly found in automotive drive trains) may not have sufficient rotational degrees of freedom to prevent the joint from becoming over-constrained and locking up. Over-restraint of this joint may mean that the joint, and by extension the rotation restraint mechanism, cannot move freely as required.

One mechanism layout suggested by U.S. Pat. No. 4,235,116 has the restraint gimbals 60, 70 formed from large rings or portions of rings 63, 73 that fit around the outside of the reciprocator 34 and connecting rods 41. This means that the casings surrounding the reciprocator may need to be increased in diameter in order to accommodate the gimbals, potentially increasing the overall size and weight of the axial piston machine. Because this gimbal structure connects the two gimbal hinge bearings 38 or 71, and the gimbal tip pivot 64 with what are in effect bowed beams, such gimbals may generally need to be made much heavier than if they were comprised of more structurally efficient straight beams in order to have sufficient rigidity to bear the rotation restraint and inertial forces encountered in high speed operation. This greater mass may lead to still higher inertial loadings and a requirement for heavier gimbal hinge and gimbal linking bearings, and can greatly increase the loads on the reciprocator bearings 32. The higher bearing loads created by heavy gimbals leads to increased frictional losses and may limit the maximum speed and power of the machine.

In order to balance the inertial forces created by the motion of the gimbals U.S. Pat. No. 4,235,116 teaches that the gimbals 60, 70 be balanced by mass 76 and 66 such that their respective centres of mass are located on the axes of their respective hinge bearings 38, 71, to allow for the balancing of inertial forces in the machine. This is a restrictive solution to the problem of balancing the gimbals. The practicality of employing these solutions for the balancing of the gimbals in a high speed axial piston engine may be severely hampered by the extra weight and bulk of the gimbals and other elements that can make it difficult to package the mechanism compactly. The extents of the gimbals on the opposite side of the hinge axis from the gimbal linking pivot joints may be difficult to accommodate without interfering with the desired positions of other components. At high speeds the greater rotational inertias and masses of these balanced gimbals may also lead to very high inertial loads that are transmitted through the gimbal and reciprocator bearings. These gimbal inertia-induced bearing loads may be impractically high, limiting the maximum operating speed of the machine, limiting life and leading to increased frictional losses. Undesirable gyroscopic forces may also be established.

It is accordingly an object of this invention to provide a rotation restraint mechanism for z crank axial piston machines that may offer a number of improvements to some or all of the disadvantages that are outlined by reference to the prior art discussed above or to at least offer the public a useful choice.

BRIEF DESCRIPTION OF THE INVENTION

Accordingly in a first aspect the present invention consist in an axial piston machine acting as a thermodynamic engine, compressor, motor or pump comprising;

a crankshaft rotatable about a crankshaft axis and carrying a crank journal having an inclined crank axis that is oblique to the crankshaft axis but aligned to intersect therewith at an acute angle A at a point (point X) on the crankshaft, a cylinder cluster comprising at least two cylinders rigidly located with respect to each other, each cylinder spaced relative to the other(s) about a cylinder cluster axis, each said cylinder including at least one cylinder opening to allow fluid inlet and/or outlet to/from said cylinder, in each cylinder, a complementary piston to reciprocate along a reciprocating axis defined by its respective cylinder, a reciprocator mounted to rotate about said crank journal about said inclined crank axis, said reciprocator operatively connecting said pistons with said crank journal such that the rotational motion of the crankshaft with respect to the cylinder cluster drives the reciprocal motion of the pistons within their respective cylinders or visa versa, and allows consistent and controlled reciprocating displacement of each piston within its respective cylinder between top dead centre (TDC) and bottom dead centre (BDC)

a rotation restrainer operative between said cylinder cluster and said reciprocator to restrain relative movement therebetween about the crankshaft axis, said rotation restrainer being comprised of two gimbal arms, said gimbal arms linked together by a gimbal link joint with multiple rotational degrees of freedom and that intersect at a point T, point T lying in a medial plane M being defined as the plane passing through point X to which the line that bisects angle A is normal, wherein each of said gimbal arms is pivotally mounted at an identical distance L from point T, one of said gimbal arms, hereinafter referred to as the "cylinder gimbal", being pivotally mounted from said cylinder cluster about a cylinder gimbal pivot axis, the second of said gimbal arms, hereinafter referred to as the "reciprocator gimbal" being pivotally mounted from said reciprocator about a reciprocator gimbal pivot axis, said reciprocator gimbal pivot axis positioned equidistant from point X and T as is the cylinder gimbal pivot axis, the orientations of the pivot axes of the two gimbal arms being mutual reflections in the medial plane M resulting in the point T lying on the medial plane M as the crankshaft rotates with respect to the cylinder cluster, and thus ensuring homo-kinetic rotational restraint between said reciprocator and said cylinder cluster.

Preferably said cylinder gimbal pivot axis is normal to a plane within which the crankshaft axis lies.

Preferably the crankshaft axis lies in a plane to which the cylinder gimbal pivot axis is normal to and within which point T lies.

Preferably a line perpendicular to the said cylinder gimbal pivot axis and passing through point T, intersects or projects to intersect with the said crankshaft axis at a point C.

Preferably point C lies on the crankshaft axis.

Preferably said cylinder gimbal pivot axis is perpendicular to said crankshaft axis.

Preferably point C does not lie on the crankshaft axis.

Preferably said cylinder gimbal pivot axis is offset from said crankshaft axis yet said crankshaft axis lies in a plane normal to the cylinder gimbal pivot axis.

Preferably said reciprocator gimbal pivot axis is normal to a plane within which the crank axis lies.

Preferably the crank axis lies in a plane to which the reciprocator gimbal pivot axis is normal to and within which point T lies.

Preferably a line perpendicular to the said reciprocator gimbal pivot axis and passing through point T, intersects or projects to intersect with the said crank axis at a point R.

Preferably point R lies on the crank axis.

Preferably said reciprocator gimbal pivot axis is perpendicular to said cranks axis.

Preferably point R does not lie on the crank axis.

Preferably said reciprocator gimbal pivot axis is offset from said crank axis yet said crank axis lies in a plane normal to the reciprocator gimbal pivot axis.

Preferably said point R is at identical respective distances from point X and T as is point C, the orientations of the pivot axes of the two gimbal arms being mutual reflections in the medial plane M resulting in the point T always on the medial plane M as the crankshaft rotates with respect to the cylinder cluster, and thus ensuring homo-kinetic rotational restraint between said reciprocator and said cylinder cluster.

Preferably the gimbal aims each have two ends, a proximal end at or near where their respective pivot axes and a distal end at or near point T.

Preferably said reciprocator is mounted to rotate on two axially along said crank journal spaced apart reciprocator bearings about said crank journal.

Preferably said reciprocator bearing closest to said cylinder cluster is also closer to point X than the other reciprocator bearing that is most distal to the cylinder cluster.

Preferably said gimbal link joint links together said reciprocator gimbal and said cylinder gimbal, said gimbal link joint having two rotational degrees of freedom that intersect at point T and allow the reciprocator gimbal and cylinder gimbal to rotate relative to one another without restriction in the manner required for homo-kinetic rotation restraint Preferably said gimbal link joint provides said rotational degrees of freedom by plain or roller bearings, the first axis of rotation of said gimbal link joint coincident the line between points C and T, the second axis of rotation of said gimbal link joint coincident the line between points R and T, the angle formed between these two axes being invariant for a given angle A when said cylinder gimbal pivot axis is mounted to intersect with the axis of said crankshaft at point C and the reciprocator gimbal pivot axis is mounted to intersect with said inclined crank axis at point R.

Preferably in operation each of said gimbal link joint's two rotational degrees of freedom rotate through the same range of motion and preferably the bearings of said gimbal link joint are suitable for operation with low frictional losses whilst being subjected to large and rapidly oscillating rotations and loads.

Preferably said gimbal link joint defines a principal pivot and supplementary pivots that all have axes of rotation that pass through point T, said principal pivot having a principal pivot axis of rotation oriented with respect to the gimbals such that in operation the principal pivot axis passes from point T through or near to point X throughout the range of motion of said gimbals.

Preferably said principal pivot is defined by plain or roller bearings that form part of the linking joint between the two gimbals, said principal pivot to accommodate the majority of all relative rotational motion between the two said restraint gimbals, said supplementary pivots incorporated into said gimbal link joint being subjected to relatively small ranges of oscillatory rotation, the axes of rotation of said supplementary pivots to intersect with each other and with the principal pivot axis at acute angles at point T.

Preferably said gimbal link joint supplementary pivots have mutually perpendicular rotational axes that are also perpendicular to the principal pivot axis.

Preferably said gimbal link joint supplementary pivots are provided by plain bearings or flexures, or a combination of these, or a single spherical bearing that allows for small amplitude rotational motions in the gimbal link joint about axes other than the principal pivot axis.

Preferably said cylinder cluster, in operation, rotates with respect to a stationary frame of reference about said crankshaft axis in order to enable the fluid porting of said cylinder cluster by inlet/outlet ports defined by a ported member, there being provided in operative engagement between the crankshaft and the cylinder cluster, an indexing drive, to rotate the cylinder cluster relative the ported member upon the rotation of the crankshaft, or visa versa, said ported member being stationary to the stationary frame of reference.

Preferably said cylinder cluster and said reciprocator rotate at the same angular rate with respect to said crankshaft and crank journal respectively.

Preferably said cylinder cluster and said reciprocator rotate at the same angular rate with respect to said crankshaft and crank journal respectively, relative said ported member.

Preferably said indexing drive is an epicyclic gear, operative between said crankshaft and said cylinder cluster.

Preferably said epicyclic gear includes a sun gear mounted on said crankshaft to rotate about said crankshaft axis, an annular gear operatively connected to said cylinder cluster and rotatable about said crankshaft axis, and at least one planetary gear mounted for rotation and operation intermediate of said sun and annular gears on a rotational axis held relative to said ported member.

Preferably said sun, annular and planetary gear(s) all have their gear axis parallel to each other.

Preferably said cylinder gimbal pivot axis is the only pivot axis of the cylinder gimbal relative the cylinder cluster and the reciprocator gimbal pivot axis is the only pivot axis of the reciprocator gimbal relative to the reciprocator.

Preferably said reciprocating axis of each said pistons is parallel to the crankshaft axis.

Preferably cylinder cluster includes three or more cylinders.

Preferably said three or more cylinders of said cylinder cluster are identical and equally spaced about said crankshaft axis so that the combined kinetic energy possessed by said pistons varies by a relatively small amount as said crankshaft rotates at fixed speed with respect to said cylinder cluster.

Preferably each piston is connected to said reciprocator by a connection rod for each said piston.

Preferably each said connection rods offers two or more rotational degrees of freedom and no translational degrees of freedom between said reciprocator and each said piston to allow transfer of the linear reciprocating motion of the pistons relative to a respective cylinder to the oscillating motion of the reciprocator and visa versa.

Preferably at least two pairs of gimbal arms are provided.

Preferably a said pair of gimbal arms is positioned between each connection rod.

Preferably the number of pairs of arms corresponds to the number of cylinders of said cylinder cluster.

In a second aspect the present invention consist in an axial piston machine acting as a thermodynamic engine, compressor, motor or pump comprising;

a crankshaft rotatable about a crankshaft axis and carrying an crank journal having an inclined crank axis that is oblique to the crankshaft axis but aligned to intersect therewith at an acute angle A at point X, a cylinder cluster comprising at least two cylinders rigidly located with respect to each other, each cylinder containing a complementary piston to each reciprocate along a reciprocating axis defined by its respective cylinder and each of a cross section matched to the cross section of the cylinder, each said cylinder in fluid connection with at least one valved inlet/outlet port therefor, a reciprocator mounted to rotate relative to said crank journal about said inclined crank axis, said reciprocator in mechanical engagement with each piston to allow the requisite reciprocating displacement of each piston within its respective cylinder between top dead centre (TDC) and bottom dead centre (BDC) upon the crankshaft rotating relative to said cylinder cluster about the said crankshaft axis, at least two rotation restrainers to restrain the relative rotation between said cylinder cluster body and said reciprocator about the crankshaft axis, each of said rotation restrainers being comprised of a pair of gimbal arms linking between the reciprocator and cylinder cluster, a first of said arms being a cylinder gimbal arm pivotably connected to said cylinder cluster and pivotable thereto only about a cylinder gimbal hinge axis oblique to said crankshaft axis (but not necessarily intersecting therewith), a second of said arms being a reciprocator gimbal arm pivotably connected to said reciprocator and pivotable thereto only about a reciprocator gimbal hinge axis oblique to said inclined crank axis (but not necessarily intersecting therewith), the reciprocator gimbal arm and cylinder gimbal arm of each said pair linked together by a gimbal arm tip link having three rotational degrees of freedom that intersect at a point T1 that is equidistant from their respective gimbal arm hinge axes and always lying on the medial plane defined as the plane passing through point X to which the line that bisects angle A is normal, the orientations of the hinge axes for each pair of gimbal arms being mutual reflections in the medial plane so that as the crankshaft rotates with respect to the cylinder cluster homo-kinetic restraint of said reciprocator is ensured.

Preferably all cylinder gimbal arms are equi-spaced about said crank axis and all said reciprocator gimbal arms are equi-spaced about said crankshaft axis.

Preferably three or more rotation restrainers are provided.

Preferably the number or rotation restrainers corresponds to the number of cylinders in the cylinder cluster.

Preferably each said cylinder gimbal arm is arranged such that the combined total inertial forces created by the cylinder gimbal arms is largely balanced in a radial direction to said crankshaft axis.

Preferably each said reciprocator gimbal arm is arranged such that the combined total inertial forces created by the reciprocator gimbal arms is largely balanced in a radial direction to said crank axis.

Preferably the rotation restrainers are arranged such that the combined total inertial forces and moments created thereby is largely constant in magnitude and direction with respect to the rotating frame of reference of the crankshaft and may thus be substantially balanced by the addition of appropriate balance masses to said crankshaft.

Preferably said cylinder gimbal pivot axis is normal to a plane within which the crankshaft axis lies.

Preferably the crankshaft axis lies in a plane to which the cylinder gimbal pivot axis is normal to and within which point T1 lies.

Preferably a line perpendicular to the said cylinder gimbal pivot axis and passing through point T1, projects to intersect with the said crankshaft axis at a point C.

Preferably point C does not lie on the crankshaft axis.

Preferably said cylinder gimbal pivot axis is offset from said crankshaft axis yet said crankshaft axis lies in a plane normal to the cylinder gimbal pivot axis.

Preferably said reciprocator gimbal pivot axis is normal to a plane within which the crank axis lies.

Preferably the crank axis lies in a plane to which the reciprocator gimbal pivot axis is normal to and within which point T1 lies.

Preferably a line perpendicular to the said reciprocator gimbal pivot axis and passing through point T, projects to intersect with the said crank axis at a point R.

Preferably point R does not lie on the crank axis.

Preferably said reciprocator gimbal pivot axis is offset from said crank axis yet said crank axis lies in a plane normal to the reciprocator gimbal pivot axis.

Preferably said point R is at identical respective distances from point X and T1 as is point C, the orientations of the pivot axes of the two gimbal arms being mutual reflections in the medial plane M resulting in the point T always on the medial plane M as the crankshaft rotates with respect to the cylinder cluster, and thus ensuring homo-kinetic rotational restraint between said reciprocator and said cylinder cluster.

Preferably for each cylinder gimbal arm, said cylinder gimbal arm hinge axis is proximal more the crankshaft axis than it is to point T1.

Preferably said reciprocating axis of each said cylinder is parallel to the crankshaft axis and preferably said cylinder cluster includes three or more cylinders.

Preferably three or more cylinders of said are provided that are identical and equally spaced about said crankshaft axis Preferably this is so that the combined kinetic energy possessed by said pistons varies by a relatively small amount as said crankshaft rotates at fixed speed with respect to said cylinder cluster, thus allowing said axial piston machine to tend to being completely balanced.

Preferably said mechanical engagement of said reciprocator with each piston is provided by a connection rod as an extension from or part of said reciprocator and preferably each said connection rod linking said reciprocator and said piston have two or more rotational degrees of freedom and no translational degrees of freedom and offer sufficient degrees of freedom to allow transfer of the linear reciprocating motion of the pistons relative to a respective cylinder to the oscillating motion of the reciprocator and visa versa.

Preferably said reciprocator is mounted to rotate on two axially along said crank journal spaced apart reciprocator bearings, the body of said reciprocator to bridge between said reciprocator bearings.

Preferably said reciprocator bearing closest to said cylinder cluster is closer to point X than is the reciprocator bearing most distal to the cylinder cluster.

Preferably each said rotation restrainer is identical.

Preferably said reciprocator connects to said pistons via connection rods extending intermediate to said reciprocator and said pistons, said rotation restrainers number equal to the number of cylinders of said cylinder cluster and are mounted in the spaces between adjacent connection rods.

Preferably said reciprocator gimbal arm hinge axis and said cylinder gimbal arm hinge axis in each said gimbal arm pair are at least in part defined by two coaxial bearings axially separated and both capable of withstanding loading radial to the hinge axis and loading axial to the hinge axis.

Preferably said gimbal arm tip link of each gimbal arm pair is a spherical bearing.

Preferably each said gimbal arm tip link is comprised of three non-parallel single rotation degree of freedom pivot joints whose axes of rotation intersect at point Preferably the first of the three said single rotational degree of freedom pivot joints in each said gimbal arm pair is perpendicular to and intersects or closely approaches the reciprocator gimbal arm hinge axis, and the second of the three said single rotational degree of freedom pivot joints in each said gimbal arm pair is perpendicular to and intersects or closely approaches the cylinder gimbal arm hinge axis, and the third of the said single rotational degree of freedom pivot joints in each said gimbal arm pair is mutually perpendicular to the other two rotational degree of freedom pivot joints.

Preferably the first of the three said single rotational degree of freedom pivot joints is perpendicular to and intersects or closely approaches the reciprocator gimbal arm hinge axis and is comprised of two axially separate radial bearings and a bi-directional thrust bearing, and the second of the three said single rotational degree of freedom pivot joints is perpendicular to and intersects or closely approaches the cylinder gimbal arm hinge axis and is comprised of two axially separate radial bearings and a bi-directional thrust bearing, and the third of the said single rotational degree of freedom pivot joints is mutually perpendicular to the other two rotational degree of freedom pivot joints and is comprised of a one or more radial bearings and a bi-directional thrust bearing.

Preferably one or more of the thrust bearings and/or the radial bearings of said single rotational degree of freedom pivot joints and/or gimbal arm hinge axis pivots incorporates intermediate bearing elements that rotate with respect to both gimbal arm components that the said bearing/s link together.

Preferably this results in, during operation of the machine, the sliding velocities between said intermediate bearing elements and their respective contacting gimbal arm components being less than the sliding velocities between said respective gimbal arm components in the absence of said intermediate bearing elements, for a floating thrust washers or floating journal bearing element may be included that reduce the individual sliding velocities of bearings by effectively stacking bearings on top of each other.

Preferably said cylinder cluster is mounted to rotate with respect to a stationary frame of reference about said crankshaft axis and valving of each valved inlet/outlet port is controlled by ported member relative to which cylinder cluster rotates to bring said inlet/outlet ports into sequential association with ports of an otherwise valved inlet/outlet port sealing facilitating ported member, in order to enable the fluid transfer to and from the cylinders of the cylinder cluster corresponding to the appropriate location of the pistons in their movement between TDC and BDC.

Preferably an indexing drive is provided acting intermediate of said cylinder cluster and said ported member in order to index the rotation of the cylinder cluster relative the ported member.

Preferably said rotation restrainer acts between said cylinder cluster and said reciprocator so that they rotate at the same angular rate with respect to said crankshaft and crank journal respectively and relative said ported member.

Preferably each rotation restrainer acts between said cylinder cluster and said reciprocator to restrain their relative rotation with respect to said crankshaft and crank journal respectively.

In a further aspect the present invention consists in a reciprocator restraint assembly of or for a Z-crank axial piston machine that includes a crankshaft rotatable about a crankshaft axis and carrying a crank journal having an inclined crank axis that is oblique to the crankshaft axis but aligned to intersect therewith at an acute angle A at a point (point X) on the crankshaft, said assembly to restrain the relative rotation between a cylinder cluster body and a reciprocator said assembly comprising:

two gimbal arms, said gimbal arms linked together by a gimbal link joint with multiple rotational degrees of freedom and that intersect at a point T, point T lying in a medial plane M being defined as the plane passing through point X to which the line that bisects angle A is normal, wherein each of said gimbal arms is pivotally mounted at an identical distance L from point T, one of said gimbal arms, hereinafter referred to as the "cylinder gimbal", being pivotally mounted from said cylinder cluster about a cylinder gimbal pivot axis, the second of said gimbal arms, hereinafter referred to as the "reciprocator gimbal" being pivotally mounted from said reciprocator about a reciprocator gimbal pivot axis, said reciprocator gimbal pivot axis positioned equidistant from point X and T as is the cylinder gimbal pivot axis, the orientations of the pivot axes of the two gimbal arms being mutual reflections in the medial plane M resulting in the point T lying on the medial plane M as the crankshaft rotates with respect to the cylinder cluster, and thus ensuring homo-kinetic rotational restraint between said reciprocator and said cylinder cluster.

Preferably said cylinder gimbal pivot axis is normal to a plane within which the crankshaft axis lies.

Preferably the crankshaft axis lies in a plane to which the cylinder gimbal pivot axis is normal to and within which point T lies.

Preferably a line perpendicular to the said cylinder gimbal pivot axis and passing through point T, intersects or projects to intersect with the said crankshaft axis at a point C.

Preferably point C lies on the crankshaft axis.

Preferably said cylinder gimbal pivot axis is perpendicular to said crankshaft axis.

Preferably point C does not lie on the crankshaft axis.

Preferably said cylinder gimbal pivot axis is offset from said crankshaft axis yet said crankshaft axis lies in a plane normal to the cylinder gimbal pivot axis.

Preferably said reciprocator gimbal pivot axis is normal to a plane within which the crank axis lies.

Preferably the crank axis lies in a plane to which the reciprocator gimbal pivot axis is normal to and within which point T lies.

Preferably a line perpendicular to the said reciprocator gimbal pivot axis and passing through point T, intersects or projects to intersect with the said crank axis at a point R.

Preferably point R lies on the crank axis.

Preferably said reciprocator gimbal pivot axis is perpendicular to said cranks axis.

Preferably point R does not lie on the crank axis.

Preferably said reciprocator gimbal pivot axis is offset from said crank axis yet said crank axis lies in a plane normal to the reciprocator gimbal pivot axis.

Preferably said point R is at identical respective distances from point X and T as is point C, the orientations of the pivot axes of the two gimbal arms being mutual reflections in the medial plane M resulting in the point T always on the medial plane M as the crankshaft rotates with respect to the cylinder cluster, and thus ensuring homo-kinetic rotational restraint between said reciprocator and said cylinder cluster.

Preferably the cylinder cluster has an odd number of cylinders.

Preferably the machine is an internal combustion engine.

In a further aspect the present inventions also consists in an axial piston machine acting as a thermodynamic engine, compressor, motor or pump comprising;

a crankshaft rotatable about a crankshaft axis and carrying an crank journal having an inclined crank axis that is oblique to the crankshaft axis but aligned to intersect therewith at an acute angle A at point X, a cylinder cluster comprising at least two cylinders rigidly located with respect to each other, each cylinder containing a complementary piston to each reciprocate along a reciprocating axis defined by its respective cylinder and each of a cross section matched to the cross section of the cylinder, each said cylinder in fluid connection with at least one valved inlet/outlet port therefor, a reciprocator mounted to rotate relative to said crank journal about said inclined crank axis, said reciprocator in mechanical engagement with each piston to allow the requisite reciprocating displacement of each piston within its respective cylinder between top dead centre (TDC) and bottom dead centre (BDC) upon the crankshaft rotating relative to said cylinder cluster about the said crankshaft axis, at least two rotation restrainers to restrain the relative rotation between said cylinder cluster body and said reciprocator about the crankshaft axis, each of said rotation restrainers being comprised of a pair of gimbal arms linking between the reciprocator and cylinder cluster, a first of said gimbals arms (herein after "a cylinder gimbal arm") pivotably connected to said cylinder cluster and pivotable thereto about a cylinder gimbal hinge axis that is normal to a plane in which the crankshaft axis lies and that is set a distance from the crankshaft axis on a side thereof so that said cylinder gimbal arm projects, from said cylinder gimbal hinge axis, away from said crankshaft a second of said arms (herein after "reciprocator gimbal arm") pivotably connected to said reciprocator and pivotable thereto about a reciprocator gimbal hinge axis that is normal to a plane in which the crank axis lies and that is set a distance from the crank axis on a side thereof so that said reciprocator gimbal arm projects, from said reciprocator gimbal hinge axis, away from said crank, the reciprocator gimbal arm and cylinder gimbal arm of each said pair linked together by a gimbal arm tip link having three rotational degrees of freedom that intersect at a point T1 that is equidistant from their respective gimbal arm hinge axes and always lying on the medial plane defined as the plane passing through point X to which the line that bisects angle A is normal, the orientations of the hinge axes for each pair of gimbal arms being mutual reflections in the medial plane so that as the crankshaft rotates with respect to the cylinder cluster homo-kinetic restraint of said reciprocator is ensured.

Preferably the cylinder arm hinge axis is defined by two spaced apart cylinder aim hinges that are coaxial each other and are located on each side of a plane within which both T1 and said crankshaft axis lie.

Preferably the reciprocator arm hinge axis is defined by two spaced apart cylinder arm hinges that are coaxial each other and are located on each side of a plane within which both T1 and said crank axis lie Preferably the indexing drive transmits rotation between said cylinder cluster and said crank shaft to, in use, rotate said cylinder cluster relative said ported member about said crankshaft axis at a rotational rate indexed to the rate of rotation of the crankshaft thereby operatively presenting said cylinder openings to some or each of said ports to allow their cyclic communication with each cylinder in turn, at instances corresponding to the desired positions in the cyclic reciprocating motion of a said piston in its respective cylinder between its TDC and BDC positioning.

Preferably said indexing drive operatively acts intermediate of said cylinder cluster and said crankshaft and comprises a crankshaft mounted sun gear to rotate with said crankshaft about the crankshaft axis and an annular gear operatively connected to said cylinder cluster to rotate with said cylinder cluster about said crankshaft axis, and at least one intermediate planetary gear operative between said sun gear and said annular gear, said at least one planetary gear mounted relative said ported member.

In a further aspect the present invention consist in A Z-crank axial piston internal combustion engine comprising a cylinder cluster of at least two piston containing cylinders rigidly located with respect to each other, each said cylinder including at least one working fluid transfer port, a crankshaft rotatable relative to said cylinder cluster and carrying an angled crank about which a reciprocator can rotate that is in mechanical connection with the pistons, said angled crank having a crank axis that is oblique to the crankshaft axis but aligned to intersect therewith at an acute angle A at a point (point X) on the crankshaft, and a ported member relative to which the cylinder cluster can rotate and that can seal the at least one fluid transfer port of each cylinder yet offers, at intervals, their exposure to spark plug(s) and/or working fluid delivery and removal facilities, an indexing drive to transmit rotation between said cylinder duster and said crank shaft to, in use, rotate said cylinder cluster relative said ported member about said crankshaft axis at a rotational rate timed to coincide with the desired range of movement of the piston in each cylinder between TDC and BDC, and two gimbal arms, said gimbal arms linked together by a gimbal link joint with multiple rotational degrees of freedom and that intersect at a point T, point T lying in a Medial plane M being defined as the plane passing through point X to which the line that bisects angle A is normal, wherein each of said gimbal arms is pivotally mounted at an identical distance, L from point T, one of said gimbal arms, hereinafter referred to as the "cylinder gimbal", being pivotally mounted from said cylinder cluster about a cylinder gimbal pivot axis, the second of said gimbal arms, hereinafter referred to as the "reciprocator gimbal" being pivotally mounted from said reciprocator about a reciprocator gimbal pivot axis, said reciprocator gimbal pivot axis positioned equidistant from point X and T as is the cylinder gimbal pivot axis, the orientations of the pivot axes of the two gimbal arms being mutual reflections in the medial plane M resulting in the point T lying on the medial plane M as the crankshaft rotates with respect to the cylinder cluster, and thus ensuring homo-kinetic rotational restraint between said reciprocator and said cylinder cluster.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

Preferred forms of the present invention will now be described with reference to the accompanying drawings in which.

DETAILED DESCRIPTION OF THE INVENTION

Where reference is made herein to acute angle A, it is also referred to as the "swash angle". Where reference is made to "rotation constraint" it is also known as "rotation restraint", "rotational constraint" or "rotational restraint".

Such restraint of constraint is also known as "torque restraint". The rotation restraint mechanism of the present invention provides for a transmission of torque between the cylinder cluster and the reciprocator.

Where reference is made to "gimbals" it refers to the "cylinder gimbal" or the "reciprocator gimbal" either individually or collectively.

Figure 1:
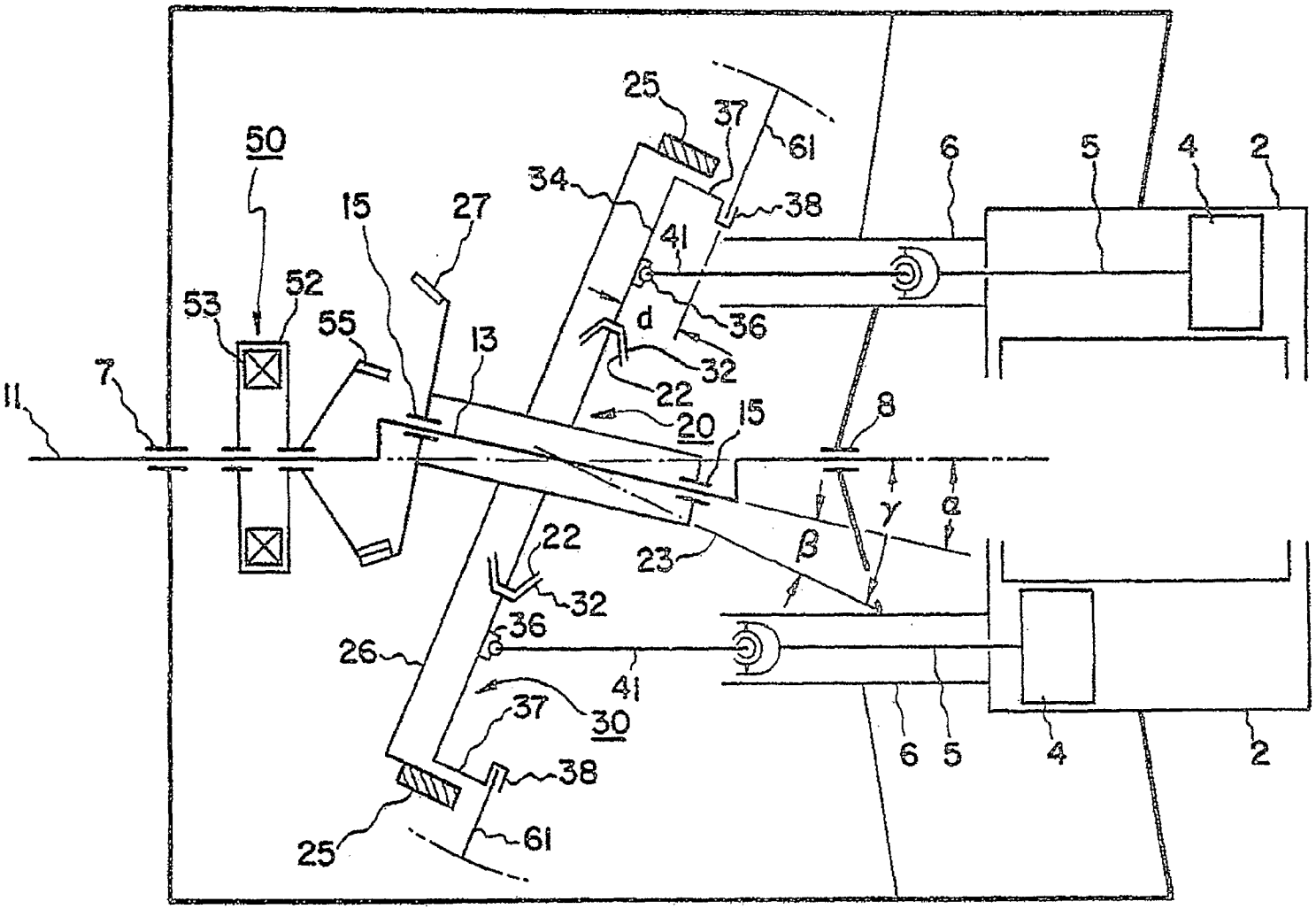
Fig 1 (Prior Art)
FIG. 1 shows as prior art an image of U.S. Pat. No. 4,235,116 that forms no part of the present invention, showing a schematic view of a gimbal system.
Figure 2:
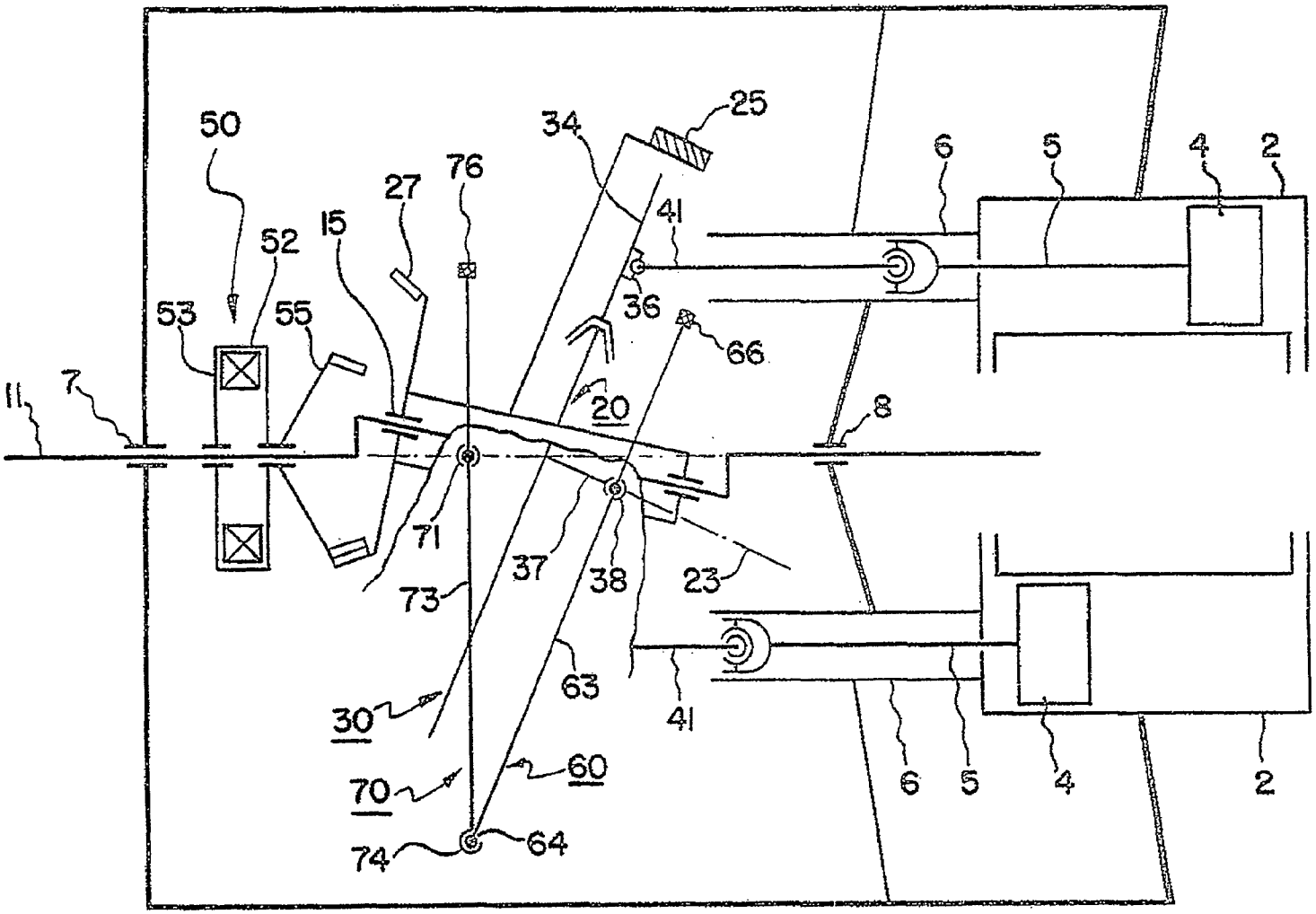
Fig 2 (Prior Art)
FIG. 2 shows as prior art an image of U.S. Pat. No. 4,235,116 that forms no part of the present invention, showing a schematic view of a gimbal system with a cutaway view to show further details.
Figure 3:
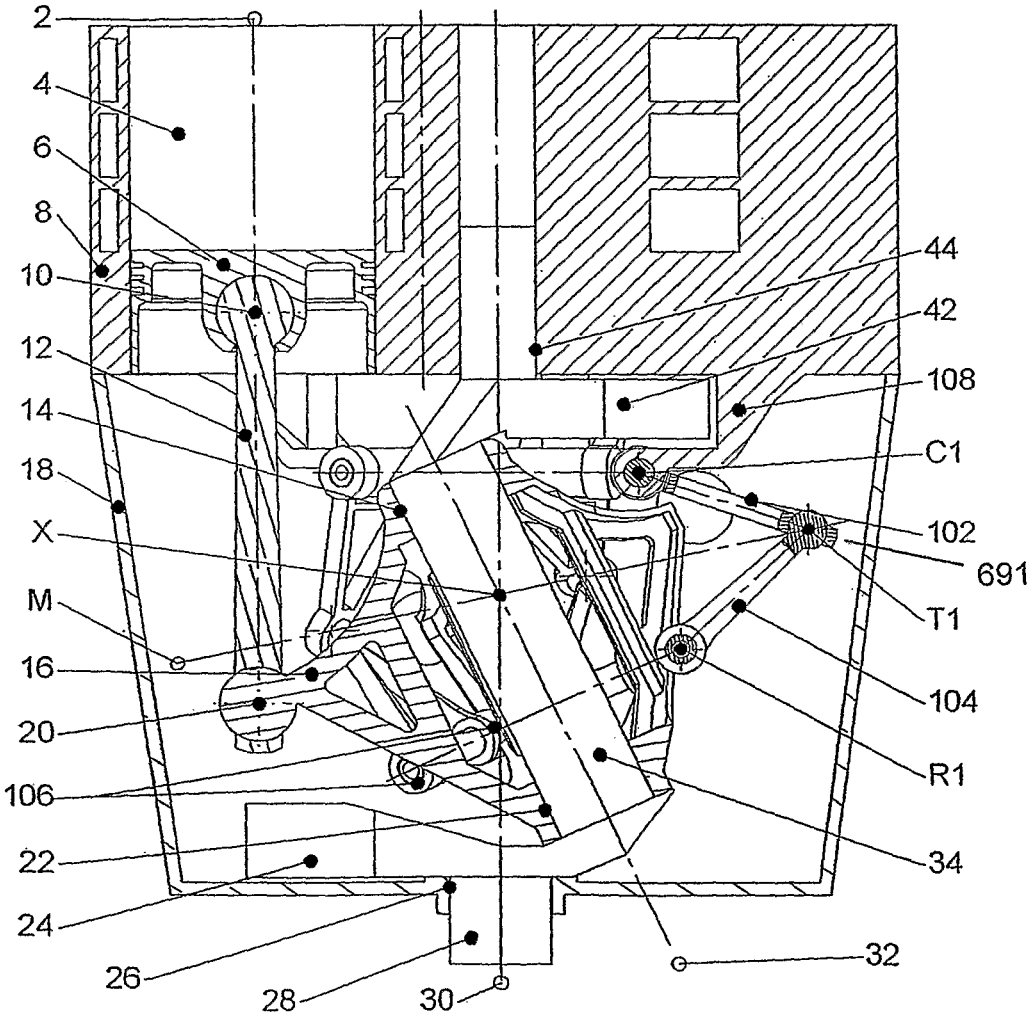
FIG. 3 is a cross sectional view of a five cylinder axial piston machine such as a pump or engine, showing the layout of the major components while omitting the cylinder heads and porting arrangements (the components shown are representative only with simplified bearings and lacking assembly details and other features that may be required in a practical machine), and utilising a rotation restraint mechanism comprised of a plurality of gimbal arm pairs, each having a simple spherical tip link.

With reference to FIG. 3 there is shown in essence a simplified cross sectional drawing of a preferred form of an axial piston machine. It omits any cylinder head or fluid porting detail. By way of example, U.S. Pat. No. 6,494,171 describes the relationship between the cylinder cluster and the cylinder and the ports that provide the utilities for the operation of an axial piston machine as an internal combustion engine. U.S. Pat. No. 6,494,171 is accordingly hereby incorporated by way of reference.

The axial piston machine of the present invention and with reference to FIG. 3 consists of a crankshaft 28 having a crankshaft axis 30. The crankshaft is supported along its length by multiple coaxial bearing regions 26, 44 (preferably defined by ball bearings or journal bearings) that allow the crankshaft to rotate with respect to a cylinder cluster 8.

In the preferred form the crankshaft 28 operates as a power output shaft when the axial piston machine operates as an engine or input shaft when the axial piston machine operates as a pump.

Disposed from, and either forming an integral part of, or securable to the crankshaft 28, is crank journal 34 having an crank axis 32. The crankshaft axis 30 and crank axis 32 intersect at a point X. Disposed from and rotatable on suitable bearings about the crank journal 34 is the reciprocator 16. The body of the reciprocator 16 bridges between said reciprocator bearings and the connecting rod attachment joints 20 with a structure that is robust enough to withstand the inertial and fluid forces from the pistons 6 and connecting rods 12 while endeavouring to minimise the moment of inertia of the reciprocator about point X so as to reduce the inertial forces on the reciprocator bearings. The reciprocator bearings are preferably separated by as large an axial distance on said crank journal 34 as can be easily accommodated within other constraints so as to reduce the loads and frictional losses in the reciprocator bearings The reciprocator 16 controls the reciprocating motion of the pistons 6 within the cylinders 4 of the cylinder cluster 8 by means of connection rods 12. The connection rods 12 link together the reciprocator 16 and the pistons 6 with rigid rods that have connection rod attachment joints 10, 20 with multiple rotational degrees of freedom to the piston and reciprocator respectively.

Relative rotation of the cylinders to fluid inlet and outlet ports of the ported member 676 may be effected by an indexing drive. Where the machine operates in this manner, the cylinder openings 679 can slide and be sealed relative the ported member 676 and rotate about the axis 30. The ports are positioned to sequentially come into alignment with the cylinder opening of each cylinder to allow fluid transfer to occur (and spark plug exposure to occur, if the engine is operating as a spark ignition engine).

Figure 3A:
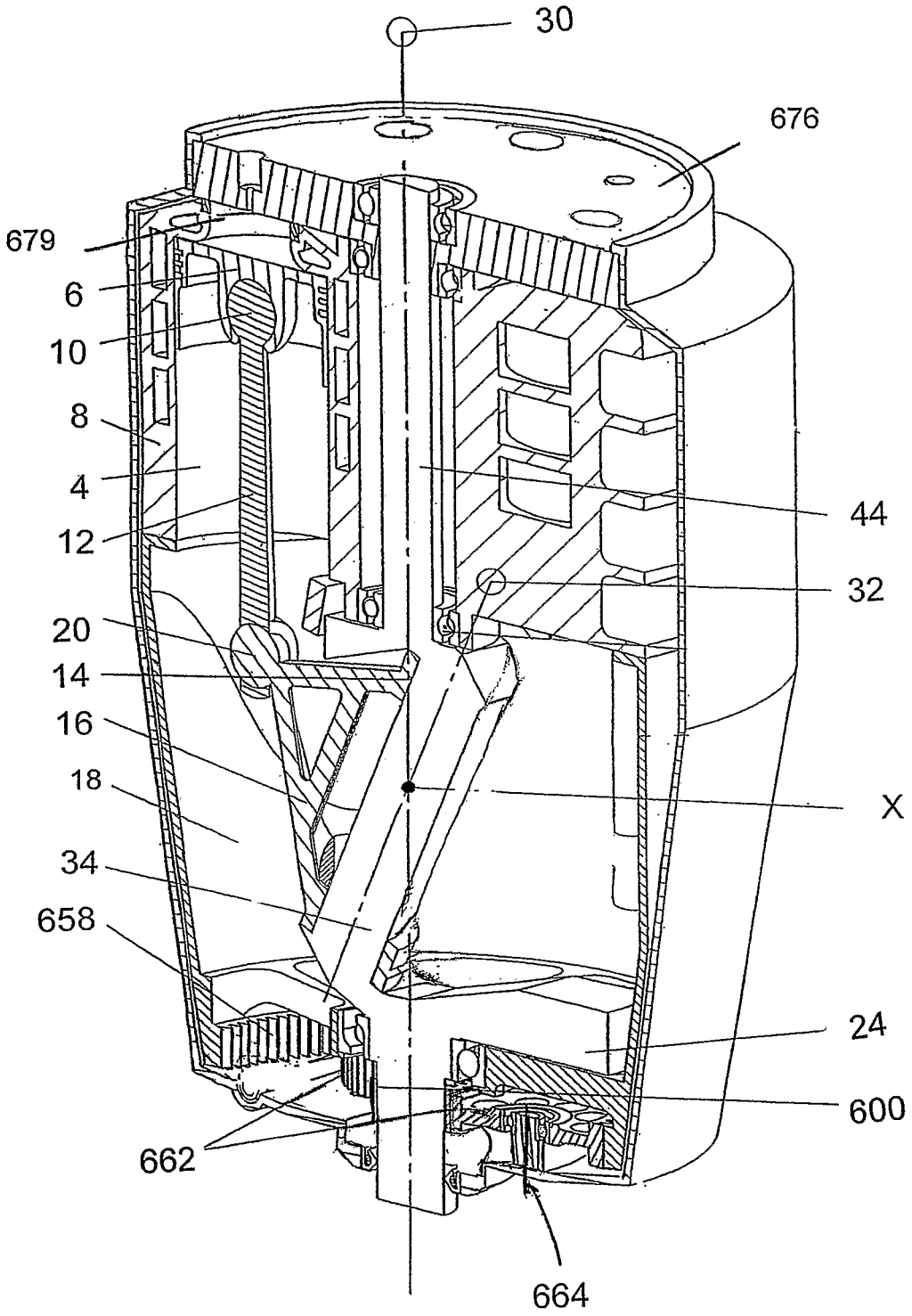
FIG. 3*a* shows more detail of an axial piston machine that can operate as an internal combustion engine, that may include the rotation restraint mechanism but with no rotation restraint mechanism shown.

The indexing drive to cause relative movement between the crankshaft, cylinders and ported member may include gearing operating between the crank shaft 28 and cylinder cluster to co or counter rotate the cylinder cluster relative the crankshaft and to rotate it relative to the ports. The relative rotation that is indexed at a rate defined by the gearing may be provided by way of an epicyclic gear set. This may include a sun gear 600 formed as part of the or engaged to be rotational with the crank shaft 28 to rotate about the crank axis 30. The sun gear 600 may engage with one or more planetary gears 662 that are positioned about the cranks shaft axis. The or each planetary gear 662 may be rotationally mounted about planetary gear axis 664 that is fixed relative the ported member. The or each planetary gear 662 may also engage with an internally toothed annular gear 658 that is fixed to the cylinder cluster 8 via housing or cradle 18. This is for example shown in FIG. 3*a*. Also shown in FIG. 3*a* is the ported member 676 that includes a plurality of inlet ports and outlet ports for fluid transfer to and from the cylinder 4 via cylinder openings 679. Spark plus openings and/or fuel injection openings may also be provided. The inlet/outlet ports of each cylinder may be provided at each cylinder directly at the main cylinder cavity or at an extension to said main cylinder cavity. Such an extension may be a duct extending between the main cylinder cavity and the inlet/outlet ports at where the ported member seals the inlet/outlet ports.

While in FIG. 3 there is shown the geometry for an axial piston machine operating with five cylinders 4, any number of cylinders could be utilised. However, three or more cylinders are generally preferred for the purposes of improved dynamic balancing.

The indexing drive ensures that the correct relative rate of rotation occurs between the crankshaft, cylinder cluster and the ported member so that the cylinder openings 679 are presented during the correct location of the piston between their top dead centre and bottom dead centre positioning when exposed to the ports of the ported member 676 for correction operation of the axial piston machine.

Dynamic balance masses 24, 42 disposed from, and either forming an integral part of, or securable to the crankshaft 28 contribute to the dynamic balancing of the inertial forces and moments created by the pistons 6, connecting rods 12, reciprocator 16, and gimbals 36, 40 of the axial piston machine.

Figure 4:
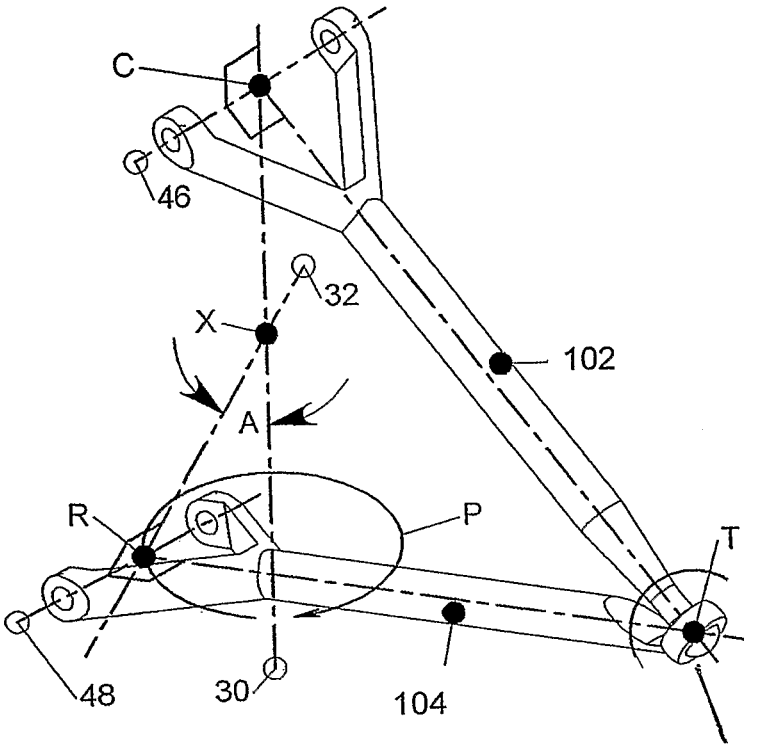
FIG. 4 is an isometric view of simplified restraint gimbals without any other machine components visible illustrating the geometric relationships of the gimbal pivots, the crank axis, the inclined crank axis and the gimbal link joint.

A reciprocator rotational restrainer that includes gimbal arms such as gimbal atins 102 and 104, (examples of which are shown in FIG. 4) may be utilised in the axial piston machine in order to restrict the relative rotation of the reciprocator 16 and cylinder cluster 8 such that the reciprocator 16 rotates at the same angular rate about the crank journal 34 as does the cylinder cluster 8 about the crankshaft 28. It also provides the required rotation reaction for the output rotation from the crank shaft or input rotation to the crankshaft 28 that would otherwise have to be reacted through for example lateral loads on the pistons 6 within their cylinders 4.

The reciprocator rotational restrainer makes it possible for each piston 6 to use a connecting rod 12 having a pivoting joint 10 with multiple (e.g. full 3-axis) degrees of rotational freedom where it links to the piston 6 and another pivoting joint 20 with multiple rotational degrees of freedom where it links to the reciprocator 16. The reciprocator rotational restrainer ensures that the reciprocator end attachment joint 20 and the piston end attachment joint 10 of the connection rod 12, that can each pivot freely, do not significantly rotationally advance or retard to each other at any time. It is in other words a rotation synchronisation mechanism to substantially synchronise the rotation of the cylinder cluster and the reciprocator about the crank shaft axis 30.

With reference to FIG. 4, the rotational constrainer comprises preferably a cylinder gimbal arm 102 and reciprocator gimbal arm 104. The cylinder gimbal arm 102 is mounted to the cylinder cluster 8. It is mounted to be pivotable thereto by bearings having an axis of rotation 46 that passes perpendicularly through the crankshaft axis 30 at a point C. The reciprocator gimbal arm 104 is mounted to the reciprocator 16. It is pivotally mounted thereto on bearings or the like with an axis of rotation 48 that passes perpendicularly through the inclined crank axis 32 at a point R.

The cylinder gimbal arm 102 and reciprocator gimbal arm 104 are linked together with a gimbal link joint 691 that allows the gimbal arms to rotate relative to each other in three axes about a common point T. Point T is equidistant from point C and point R. Point X is also equidistant from point C and point R.

Figure 4A:
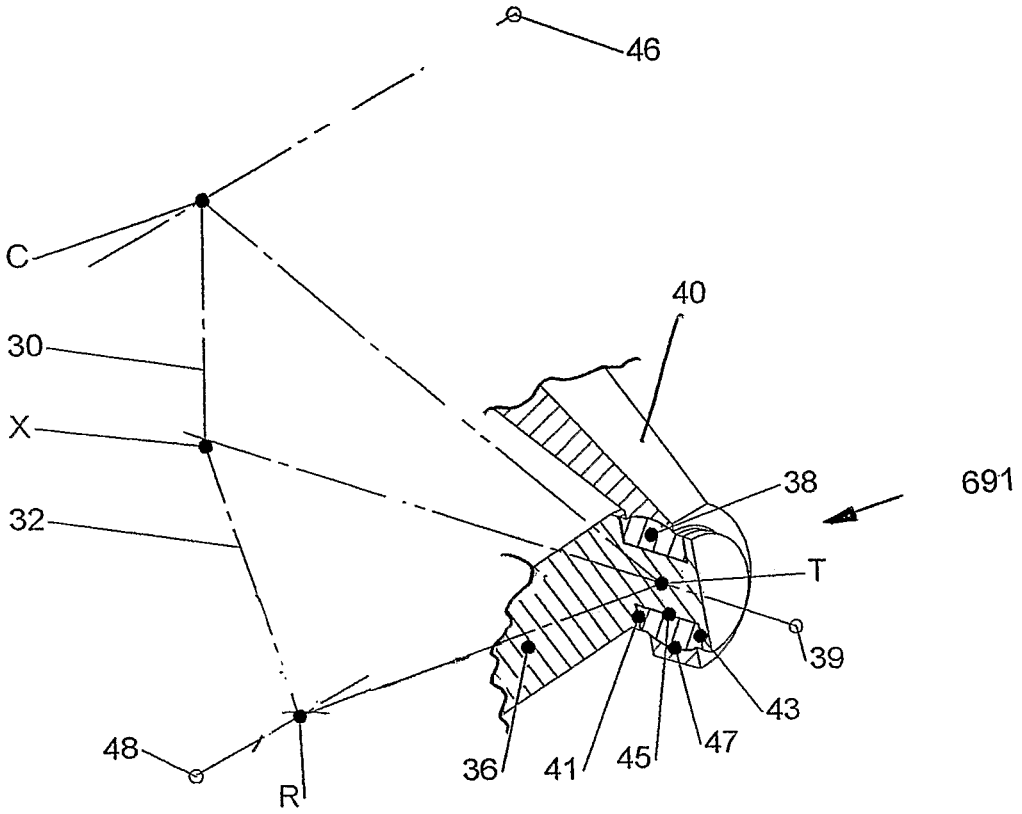
FIG. 4*a* shows more detail of a gimbal arm tip joint.
Figure 5:
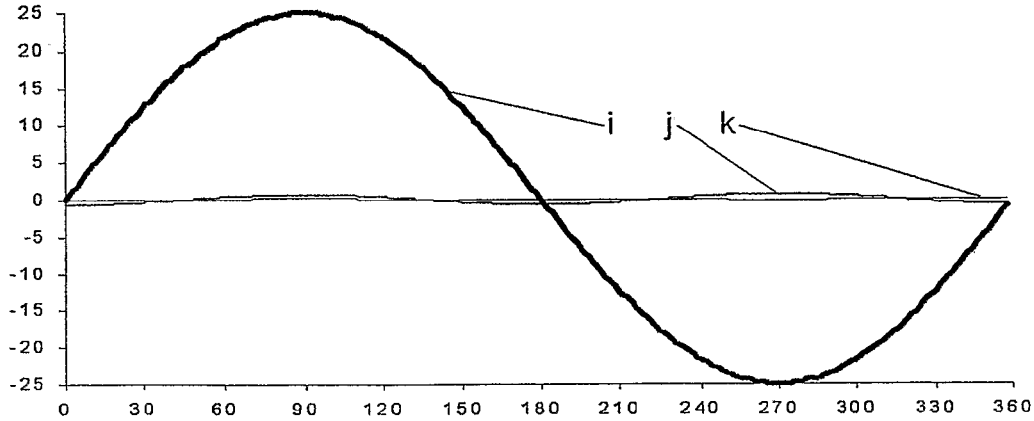
FIG. 5 shows a graph as an example of the relative rotation in degrees between the cylinder gimbal and the reciprocator gimbal about each of three orthogonal axes of rotation in the gimbal link joint of FIG. 4*a*, the graph abscissa is the crankshaft rotation angle.
Figure 5A:
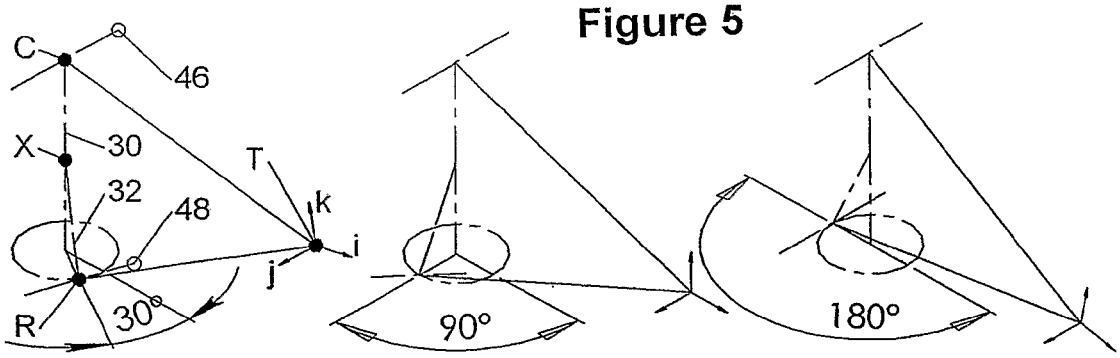
FIG. 5*a* shows an isometric view of three positions of gimbal geometry that correspond to three points along the abscissa of the graph of FIG. 5 with the graphed lines of FIG. 5 corresponding to rotations about a set of axes depicted on the gimbal tip joints in FIG. 4*a*.

A gimbal link joint 691 shown in greater detail in isometric cross section in FIG. 4*a*, incorporates a compound spherical bearing and plain bearing intermediate body 38 in which the inner plain journal 45 and thrust bearings 41, 43 together comprising a single rotational bearing (that is generally better suited to large oscillatory rotations) has a primary axis of rotation 39. This axis of rotation 39 will move slightly relative to point X with the rotation of the reciprocator gimbal 36 about the reciprocator pivot axis 48 but the axis of rotation 39 is preferably oriented to have approximately minimal deviation from point X in order to reduce the rotations about other axes in the tip. The single rotational bearing is subjected to the largest range of rotation of the gimbal link joint's bearings, the largest rotation occurring about the primary axis 39. The outer spherical bearing 47 of the intermediate body 38 is subjected to the relatively small residual rotations not accommodated by the single rotational bearing. The relative magnitudes of the rotations about the primary axis of rotation 39 and each of two other orthogonal axes of rotation in this gimbal link joint 37 are illustrated in FIG. 5 and FIG. 5*a* explained below.

In a reference frame fixed to the reciprocator, the primary axis of rotation 39 of the gimbal link joint 691 (also shown in cross section in FIG. 4*a*) moves around slightly, passing nearby but not always through point X.

Figure 6:
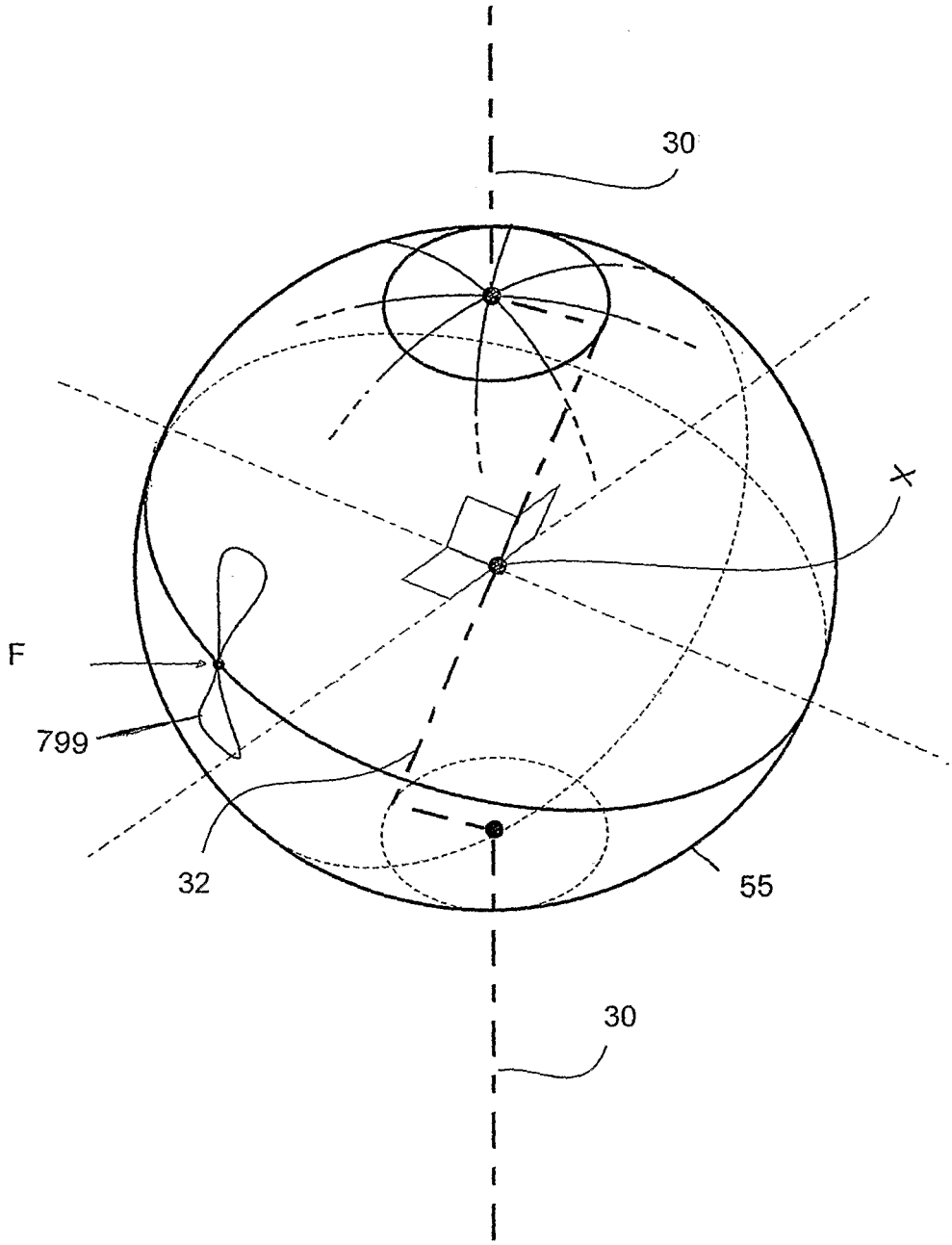
FIG. 6 illustrates the figure of eight path traveled by a point on the reciprocator at or near where the connection rod is engaged in non rotating reference frame of the reciprocator.

The figure-of-eight movement 799 shown in FIG. 6 describes any fixed point F on a truly 'homokinetic' reciprocator (relative to the cylinder cluster) that is not on the reciprocator axis 32. When that fixed point (on an imaginary 'sphere' SS) is on a plane to which the reciprocator axis 32 is normal and intersecting point X, then the figure-of-eight is perfectly symmetrical about two axes of symmetry.

FIG. 4 illustrates a fundamental geometry of the rotational restraint gimbals. The geometry of this configuration allows only one pair of gimbal arms to be provided. The preferred multi gimbal amn pairs is shown in, for example, FIG. 7. The tip joint as shown in FIG. 4*a* may not be suitable for the multi arm pairs due to their hinge axes at the cylinder cluster and reciprocator not being coincided with axes 30 and 32 respectively.

With reference to FIG. 4 the gimbal link joint 51 between the two gimbal arms 102 and 104 at point T may be a spherical plain bearing. This is not a preferred solution owing to the general incompatibility of spherical plain bearings with large amplitude, high frequency, high load oscillatory operation.

The inclined crank axis 32 intersects with the crankshaft axis 30 at point X at an acute angle A that is the swash angle, the inclined crank axis 32 rotates synchronously with the crankshaft 28 about the crankshaft axis 30 such that point R, where the reciprocator gimbal pivot axis 48 intersects the inclined crank axis 32 perpendicularly, orbits in a circular path P about the crankshaft axis 30. The cylinder gimbal pivot axis 46 intersects the crankshaft axis 30 perpendicularly at point C, and remains stationary with respect to the cylinder cluster 8. point T is equidistant from point C and point R, while point X is also equidistant from point C and point R. A line between Point T and point C extends perpendicular to the cylinder gimbal pivot axis 46 at point C. A line between Point T and point R extends perpendicular to the reciprocator gimbal pivot axis 48 at point R. With these geometric constraints point T will always lie on the medial plane. Medial plane M, with reference to the multi arm gimbals, is shown in FIG. 3 and bisects the reflex angle between the crankshaft axis 30 and the inclined crank axis 32 at point X. In other words, the medial plane M is the plane passing through point X to which the line that bisects angle A is normal.

The rotational restraint gimbals 102 and 104 as shown in FIG. 4 do not have to have gimbal pivot axes 46, 48 that pass through and are perpendicular to the crankshaft axis 30 and the inclined crank axis 32 respectively. So long as point T remains on the medial plane M and the gimbal pivot axes 46, 48 are exactly mirrored in the medial plane M the desired homo-kinetic rotational restraint of the reciprocator 16 with respect to the cylinder cluster 8 will be maintained.

FIG. 5 is a graph showing an example of the relative rotation in degrees between the cylinder gimbal 102 and the reciprocator gimbal 104 about each of three orthogonal axes of rotation i, j, k coincident at point T in the gimbal link joint 691. In the example shown in FIG. 5 the primary pivot axis i (same as the pivot axis 39 in FIG. 4*a*) referred to in the graph is oriented with respect to the gimbals such that the mean distance between the primary pivot axis i and point X throughout the range of motion is approximately minimised. The secondary pivot axis j referred to in the graph is parallel to the cylinder gimbal pivot axis 46, and has a relatively small magnitude of oscillation. The tertiary pivot axis k of the graph of FIG. 5 is perpendicular to both the primary i and secondary j pivot axes and has a very small (but non-zero) magnitude of oscillation. FIG. 5*a* is an isometric illustration of the gimbals in three consecutive geometric configurations as indicated by angles 30, 90 and 180 degrees of crankshaft rotation, with 0 degree of crankshaft rotation being the instant at which the point T is most distal point X, the crankshaft rotation corresponds to the abscissa of the graph of FIG. 5.

FIG. 3 shows a multi-arm rotation restraint mechanism having number of identical pairs of gimbal arms equal to the number of cylinders is arrayed about the engine in a symmetrical manner. Each pair of gimbal arms being comprised of a cylinder gimbal arm 102 and a reciprocator gimbal arm 104. The cylinder gimbal arm 102 is pivotably mounted on a cylinder aim hinge axis C1 on an extension 108 formed as part of or attached to the cylinder cluster 8. The pivot mount allows the cylinder arm 102 to rotate with respect to the cylinder cluster 8 about an axis perpendicular to the crankshaft axis, while constraining any motion along the cylinder arm hinge axis C1. The reciprocator gimbal arm 104 is pivotably mounted on a reciprocator gimbal arm hinge axis R1 off of the reciprocator 16, the pivot mount allowing the reciprocator arm 104 to rotate about an axis perpendicular to the crank axis, relative to the reciprocator 16 while preventing any motion along the reciprocator gimbal arm hinge axis R1.

The cylinder gimbal arm 102 and the reciprocator gimbal arm 104 of each pair are linked together by a universal tip joint possessing three rotational degrees of freedom that intersect at a point T1. In the case of FIG. 3 a spherical bearing is used for simplicity, though other tip joint configurations having three intersecting rotational degrees of freedom may be more advantageous. The point T1 of the tip joint is at an identical distance from the respective pivoting hinge axes R1 and C1 of the arm pairs and in operation the locus of the tip joints T1 for all of the pairs of arms will always lie on the medial plane M which in FIG. 3 is in an instantaneous orientation perpendicular to the plane of the drawing. This implies and requires that the pivoting hinge axes R1 and C1 of each pair of arms be exact mirrors of each other in the medial plane M, or in other words the cylinder gimbal aim hinge axis C1 must be exactly the same distance from the crankshaft axis 30 and point X as the reciprocator gimbal arm hinge axis R1 is from the crank axis 32 and point X respectively, to ensure homo-kinetic operation of the multiple gimbal arm rotation restraint system.

All the cylinder gimbal arm hinge axes and all the reciprocator gimbal arm hinge axes of the restraint mechanism of FIG. 3 are positioned to be rotationally symmetric about the crankshaft axis 30 and crank axis 32 respectively, and are preferably located between the connection rod 12 to reciprocator 16 pivot joints 20 as shown to allow for a more compact implementation of multiple arm rotation restraint. The bearings of the cylinder gimbal aim hinge axes and the bearings of the reciprocator gimbal arm hinge axes must be able to withstand operation with substantial loads applied to them both parallel and perpendicular to their hinge axes as each arm applies a significant moment and inertial load to its hinge mount, the moments in particular desire relatively large axial spacings between the bearings that form the hinge axes as is illustrated by the example of reciprocator gimbal arm hinge bearings 106 that form one of the reciprocator gimbal arm hinge axes.

The total rotation restraint required is shared between the multiple pairs of gimbal arms, so that the individual arms and their bearings need only take a proportion of the total load and may thus be made individually smaller than for a single pair of gimbal arms. In order to ensure that sharing of the total restraining rotation occurs between the multiple pairs of gimbal arms such as arms 102, 104 etc a small degree of compliance may be useful either in the form of slight bending of the arms 102, 104 themselves in response to applied loads at T1 parallel to their respective hinge axes R1 or C1, or alternatively from a small amount of sprung axial compliance in the thrust bearings of the arms' respective hinge axes R1, C1 or alternatively from a small amount of compliance of the cylinder arm hinge axis C1 on the extension 108 formed as part of or attached to the cylinder cluster 8.

The rotationally symmetric positioning of the arm pairs means that for engines with three or more arm pairs the inertial forces and moments produced by the motion of the aims can be almost completely balanced out by suitable balance masses attached to the crankshaft, thereby resulting in an engine with less noticeable vibrations. By offsetting the hinge axes C1, R1 radially outwards from the crankshaft axis 30 and crank axis 32 respectively there is more space made available for the structure of the reciprocator 16, its bearings 14, 22 and the crankshaft front balance mass 42.

Figure 7:
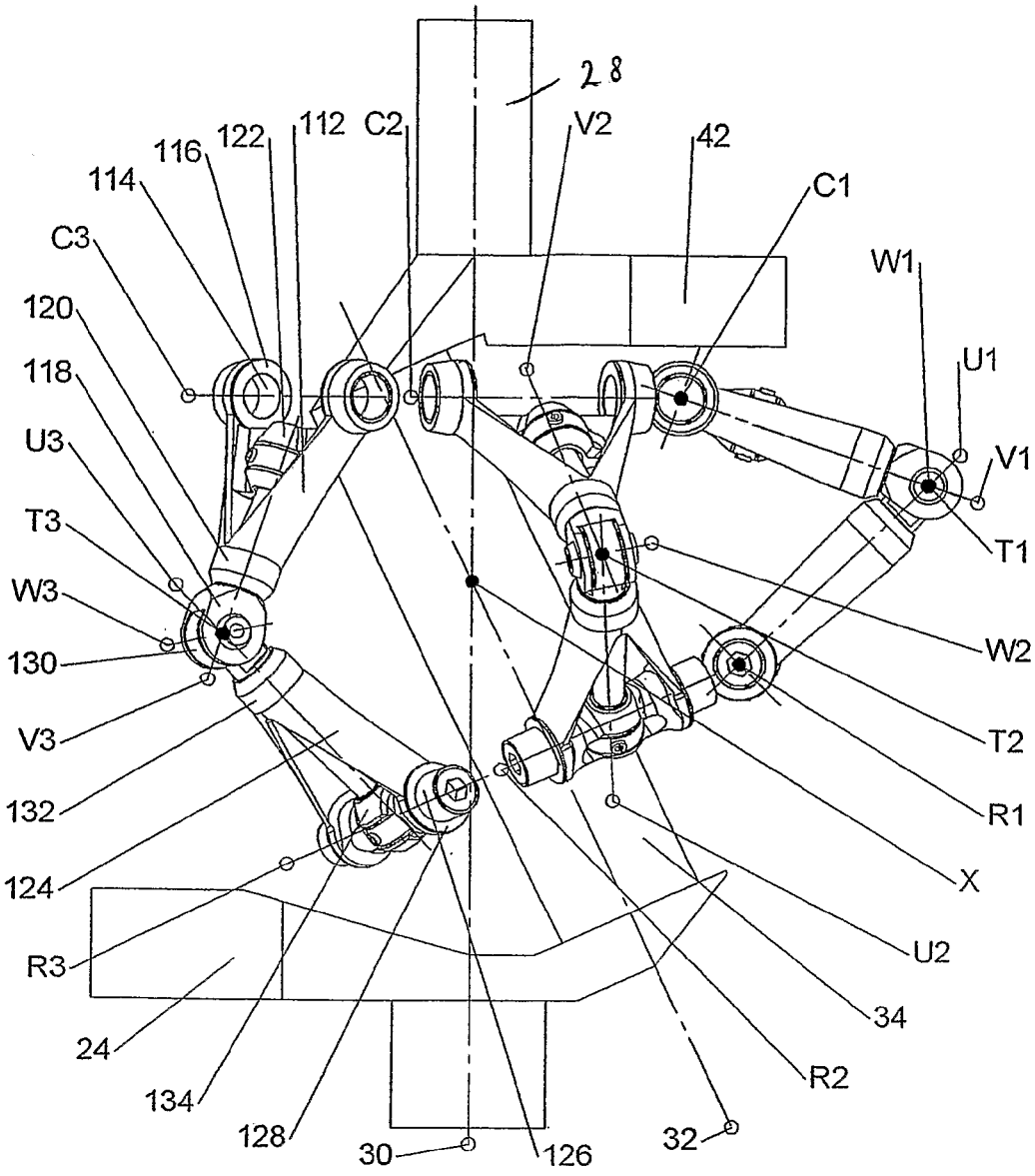
FIG. 7 is a view of a five cylinder engine similar to that of FIG. 3 in which all components are hidden excepting the crankshaft and the multiple gimbal arm pairs that each incorporates an alternative tip link to those of the engine of FIG. 3.

FIG. 7 shows the exact same engine of FIG. 3 with an alternative design of universal tip joint for the multiple arm pairs that instead employs a compound joint possessing three independent and intersecting rotational degrees of freedom. All components excepting the crankshaft 28 and five arm pairs (two of which are directly behind other gimbal arm pairs and so are completely obscured) are hidden for clarity. The cylinder arm 112 pivots about the cylinder arm hinge axis C3 on two coaxial radial Bearing 114 and thrust Bearings 116 that run on a complementary cylinder cluster mount 108 (not shown). The cylinder arm 112 incorporates a complementary cylinder arm forked knuckle 118 that rotates about axis V3 with respect to the cylinder arm 112 on two axially separated bearings at locations 120 and 122 that also prevent axial movement of the cylinder arm forked knuckle 118 along the axis V3 with respect to the cylinder arm 112. The reciprocator arm 124 pivots about the reciprocator arm hinge axis R3 on two coaxial radial bearings 126 and thrust bearings 128 that run in the reciprocator 16 (not shown). The reciprocator arm 124 incorporates a complementary reciprocator arm clevis knuckle 130 that rotates about axis U3 with respect to the reciprocator arm 124 on two axially separated beatings at locations 132 and 134 that also prevent axial movement of the reciprocator arm clevis knuckle 130 along the axis U3 with respect to the reciprocator arm 124. The cylinder arm forked knuckle 118 and the reciprocator arm clevis knuckle 130 are linked together in the fork-and-clevis type knuckle pivot by radial and thrust bearings that allow them to rotate with respect to each other about the tip hinge axis W3 which is perpendicular to the axes U3 and V3. All three axes U3, V3, W3 intersect at tip joint point T3 which lies on the medial plane M (not shown). For the two other gimbal arm pairs visible in FIG. 7 C1, C2 are cylinder arm hinge axes; R1, R2 are reciprocator arm hinge axes; W1, W2 are gimbal arm tip hinge axes; V1, V2 are the cylinder arm forked knuckle rotation axes; U1, U2 are the reciprocator arm clevis knuckle rotation axes. T1, T2 are the tip joint points.

The arm bearings may be rolling element or plain bearings, but if plain bearings are utilised then in some cases it may be necessary to utilised floating bushes and/or thrust washers in order to reduce the friction and wear of the bearings. For example in the implementation depicted in FIG. 7 the knuckle pivot is subjected to a greater range of angular motion than are the other gimbal arm bearings and may benefit significantly from the utilisation of floating bearings.

The axial piston machine of the present invention is not necessarily restricted to the cylinder axis 2 of each cylinder 4 being parallel. Indeed these cylinders may have an axis at an oblique angle to the crankshaft axis 30. Additionally, and although we have herein described an axial piston machine operating in a single sided mode, the axial piston machine of the present invention can be utilised so as to have two clusters of pistons 6 and cylinders 4 sharing a common reciprocator 16 on a crankshaft 28 and crankshaft axis 30 and arranged to act in substantially opposite directions. The axial piston machine of the present invention may have a stationary cylinder cluster arrangement. The cylinder cluster 8, cylinder cradle 18 and all other components shown in FIG. 3 could be mounted within bearings to rotate about the crankshaft axis 30 to facilitate fluid porting requirements as shown in FIG. 3*a*.

The machine or engine as herein described may include other features that may provide some benefits. Such are described in co existing complete specifications of NZ 560586 and NZ 560587.

Where reference here in is made to "rotation about" or similar, such as "rotation about the crankshaft axis" it is to be understood that is could mean to refer to a complete revolution or revolutions or partial revolution about for example the crankshaft axis. The engine or machine of the present invention may be configured of any number of cylinders' though 3 or more is preferred. Where the machine is operating as an internal combustion engine, fluid that passes through the ports may be a fuel and/or fuel/air mixture.

The cylinder cluster as herein referred to can be a cylinder block that has cylindrical bores provided therein. Alternatively it may be comprised of discrete cylinders that are affixed to each other by way of a frame or the like. Each cylinder defines a combustion chamber where the present invention is provided to operate as an internal combustion engine.

The invention claimed is:

1. An axial piston machine acting as a thermodynamic engine, compressor, motor or pump comprising;

a crankshaft rotatable about a crankshaft axis and carrying a crank journal having an inclined crank axis that is oblique to the crankshaft axis but aligned to intersect therewith at an acute angle A at a point (point X) on the crankshaft, a cylinder cluster comprising at least two cylinders rigidly located with respect to each other, each cylinder spaced relative to the other(s) about a cylinder cluster axis, each said cylinder including at least one cylinder opening to allow fluid inlet and/or outlet to/from said cylinder, in each cylinder, a complementary piston to reciprocate along a reciprocating axis defined by its respective cylinder, a reciprocator mounted to rotate about said crank journal about said inclined crank axis, said reciprocator operatively connecting said pistons with said crank journal such that the rotational motion of the crankshaft with respect to the cylinder cluster drives the reciprocal motion of the pistons within their respective cylinders or visa versa, and allows consistent and controlled reciprocating displacement of each piston within its respective cylinder between top dead centre (TDC) and bottom dead centre (BDC)

at least one rotation restrainer operative between said cylinder cluster and said reciprocator to restrain relative movement therebetween about the crankshaft axis, each said rotation restrainer being comprised of two gimbal arms, said gimbal arms linked together by a gimbal link joint with multiple rotational degrees of freedom and that intersect at a point T, point T lying in a medial plane M being defined as the plane passing through point X to which the line that bisects angle A is normal, wherein each of said gimbal arms is pivotally mounted at an identical distance L from point T, one of said gimbal arms, hereinafter referred to as the "cylinder gimbal", being pivotally mounted from said cylinder cluster about a cylinder gimbal pivot axis, the second of said gimbal arms, hereinafter referred to as the "reciprocator gimbal" being pivotally mounted from said reciprocator about a reciprocator gimbal pivot axis, said reciprocator gimbal pivot axis positioned equidistant from point X and point T respectively as is the cylinder gimbal pivot axis, the orientations of the pivot axes of the two gimbal arms being mutual reflections in the medial plane M resulting in the point T lying on the medial plane M as the crankshaft rotates with respect to the cylinder cluster, and thus ensuring homo-kinetic rotational restraint between said reciprocator and said cylinder cluster.

2. The machine as claimed in claim 1 wherein said cylinder gimbal pivot axis is normal to a plane within which the crankshaft axis lies.

3. The machine as claimed in claim 1 wherein the crankshaft axis lies in a plane to which the cylinder gimbal pivot axis is normal to and within which point T lies.

4. The machine as claimed in claim 1 wherein a line perpendicular to the said cylinder gimbal pivot axis and passing through point T, intersects or projects to intersect with the said crankshaft axis at a point C.

5. The machine as claimed in claim 4 wherein point C lies on the crankshaft axis.

6. The machine as claimed in claim 1 wherein said cylinder gimbal pivot axis is perpendicular to said crankshaft axis.

7. The machined as claimed in claim 1 wherein said cylinder gimbal pivot axis is offset from said crankshaft axis yet said crankshaft axis lies in a plane normal to the cylinder gimbal pivot axis.

8. The machine as claimed in claim 1 wherein said reciprocator gimbal pivot axis is normal to a plane within which the crank axis lies.

9. The machine as claimed in claim 1 wherein the crank axis lies in a plane to which the reciprocator gimbal pivot axis is normal to and within which point T lies.

10. The machine as claimed in claim 1 wherein a line perpendicular to the said reciprocator gimbal pivot axis and passing through point T, intersects or projects to intersect with the said crank axis at a point R.

11. The machine as claimed in claim 10 wherein point R lies on the crank axis.

12. The machine as claimed in claim 11 wherein said reciprocator gimbal pivot axis is perpendicular to said cranks axis.

13. The machine as claimed in claim 11 wherein said reciprocator gimbal pivot axis is offset from said crank axis yet said crank axis lies in a plane normal to the reciprocator gimbal pivot axis.

14. The machine as claimed in claim 10 wherein said point R is at identical respective distances from point X and point T as is point C, the orientations of the pivot axes of the two gimbal arms being mutual reflections in the medial plane M resulting in the point T always on the medial plane M as the crankshaft rotates with respect to the cylinder cluster, and thus ensuring homo-kinetic rotational restraint between said reciprocator and said cylinder cluster.

15. The machine as claimed in claim 1 wherein the gimbal arms each have two ends, a proximal end at or near where their respective pivot axes and a distal end at or near point T.

16. The machine as claimed in claim 1 wherein said reciprocator is mounted to rotate about said crank journal on two reciprocator bearings that are axially spaced along said crank journal.

17. The machine as claimed in claim 16 wherein said reciprocator bearing closest to said cylinder cluster is also closer to point X than the other reciprocator bearing that is most distal to the cylinder cluster.

18. The machine as claimed in claim 1 wherein said gimbal link joint links together said reciprocator gimbal and said cylinder gimbal, said gimbal link joint having two rotational degrees of freedom that intersect at point T and allow the reciprocator gimbal and cylinder gimbal to rotate relative to one another without restriction in the manner required for homo-kinetic rotation restraint.

19. The machine as claimed in claim 18 said gimbal link joint provides said rotational degrees of freedom by plain or roller bearings, the first axis of rotation of said gimbal link joint coincident the line between points C and T, the second axis of rotation of said gimbal link joint coincident the line between points R and T, the angle formed between these two axes being invariant for a given angle A when said cylinder gimbal pivot axis is mounted to intersect with the axis of said crankshaft at point C and the reciprocator gimbal pivot axis is mounted to intersect with said inclined crank axis at point R.

20. The machine as claimed in claim 1 wherein said cylinder cluster, in operation, rotates with respect to a stationary frame of reference about said crankshaft axis in order to enable a fluid porting of said cylinder cluster by inlet/outlet ports defined by a ported member, there being provided in operative engagement between the crankshaft and the cylinder cluster, an indexing drive, to rotate the cylinder cluster relative the ported member upon the rotation of the crankshaft, or visa versa, said ported member being stationary to the stationary frame of reference.

21. The machine as claimed in claim 1 wherein said cylinder cluster and said reciprocator rotate at the same angular rate with respect to said crankshaft and crank journal respectively.

22. The machine as claimed in claim 20 wherein said cylinder cluster and said reciprocator rotate at the same angular rate with respect to said crankshaft and crank journal respectively, relative said ported member.

23. The machine as claimed in claim 20 wherein said indexing drive is an epicyclic gear, operative between said crankshaft and said cylinder cluster.

24. The machine as claimed in claim 20 wherein said epicyclic gear includes a sun gear mounted on said crankshaft to rotate about said crankshaft axis, an annular gear operatively connected to said cylinder cluster and rotateable about said crankshaft axis, and at least one planetary gear mounted for rotation and operation intermediate of said sun and annular gears on a rotational axis held relative to said ported member.

25. The machine as claimed in claim 24 wherein said sun, annular and planetary gear(s) all have their gear axis parallel to each other.

26. The machine as claimed in claim 1 wherein said cylinder gimbal pivot axis is the only pivot axis of the cylinder gimbal relative the cylinder cluster and the reciprocator gimbal pivot axis is the only pivot axis of the reciprocator gimbal relative to the reciprocator.

27. The machine as claimed in claim 1 wherein said reciprocating axis of each said piston is parallel to the crankshaft axis.

28. The machine as claimed in claim 1 wherein cylinder cluster includes three or more cylinders.

29. The machine as claimed in claim 1 wherein each piston is connected to said reciprocator by a connection rod for each said piston.

30. The machine as claimed in claim 29 wherein each said connection rod offers two or more rotational degrees of freedom and no translational degrees of freedom between said reciprocator and each said piston to allow transfer of the linear reciprocating motion of the pistons relative to a respective cylinder to the oscillating motion of the reciprocator and visa versa.

31. The machine as claimed in claim 1 wherein at least two pairs of gimbal arms are provided.

32. The machined as claimed in claim 30 wherein a said pair of gimbal arms is positioned between each connection rod.

33. The machined as claimed in claim 30 wherein the number of pairs of arms corresponds to the number of cylinders of said cylinder cluster.

34. An axial piston machine acting as a thermodynamic engine, compressor, motor or pump comprising; a crankshaft rotatable about a crankshaft axis and carrying an crank journal having an inclined crank axis that is oblique to the crankshaft axis but aligned to intersect therewith at an acute angle A at point X, a cylinder cluster comprising at least two cylinders rigidly located with respect to each other, each cylinder containing a complementary piston to each reciprocate along a reciprocating axis defined by its respective cylinder and each of a cross section matched to the cross section of the cylinder, each said cylinder in fluid connection with at least one valved inlet/outlet port therefor, a reciprocator mounted to rotate relative to said crank journal about said inclined crank axis, said reciprocator in mechanical engagement with each piston to allow the requisite reciprocating displacement of each piston within its respective cylinder between top dead centre (TDC) and bottom dead centre (BDC) upon the crankshaft rotating relative to said cylinder cluster about the said crankshaft axis, at least two rotation restrainers to restrain the relative rotation between said cylinder cluster body and said reciprocator about the crankshaft axis, each of said rotation restrainers being comprised of a pair of gimbal arms linking between the reciprocator and cylinder cluster, a first of said arms being a cylinder gimbal arm pivotably connected to said cylinder cluster and pivotable thereto only about a cylinder gimbal hinge axis oblique to said crankshaft axis, a second of said arms being a reciprocator gimbal arm pivotably connected to said reciprocator and pivotable thereto only about a reciprocator gimbal hinge axis oblique to said inclined crank axis, the reciprocator gimbal arm and cylinder gimbal arm of each said pair are linked together by a gimbal arm tip link having three rotational degrees of freedom that intersect at a point T1 that is equidistant from their respective gimbal arm hinge axes and always lying on a medial plane defined as the plane passing through point X to which the line that bisects angle A is normal, the orientations of the hinge axes for each pair of gimbal arms being mutual reflections in the medial plane so that as the crankshaft rotates with respect to the cylinder cluster homo-kinetic restraint of said reciprocator is ensured.

35. The machine as claimed in claim 34 wherein all cylinder gimbal arms are equi-spaced about said crank axis and all said reciprocator gimbal arms are equi-spaced about said crankshaft axis.

36. The machine as claimed in claim 34 wherein three or more rotation restrainers are provided.

37. The machine as claimed in claim 36 wherein the number or rotation restrainers corresponds to the number of cylinders in the cylinder cluster.

38. The machine as claimed in claim 34 wherein each said cylinder gimbal arm is arranged such that the combined total inertial forces created by the cylinder gimbal arms is balanced in a radial direction to said crankshaft axis.

39. The machine as claimed in claim 34 wherein each said reciprocator gimbal arm is arranged such that the combined total inertial forces created by the reciprocator gimbal arms is balanced in a radial direction to said crank axis.

40. The machine as claimed in claim 34 wherein the rotation restrainers are arranged such that the combined total inertial forces and moments created thereby is constant in magnitude and direction with respect to the rotating frame of reference of the crankshaft and is balanced by the addition of appropriate balance masses to said crankshaft.

41. The machine as claimed in claim 34 wherein said cylinder gimbal pivot axis is normal to a plane within which the crankshaft axis lies.

42. The machine as claimed in claim 34 wherein the crankshaft axis lies in a plane to which the cylinder gimbal pivot axis is normal to and within which point T1 lies.

43. The machine as claimed in claim 34 wherein a line perpendicular to the said cylinder gimbal pivot axis and passing through point T1, projects to intersect with the said crankshaft axis at a point C.

44. The machined as claimed in claim 34 wherein said cylinder gimbal pivot axis is offset from said crankshaft axis yet said crankshaft axis lies in a plane normal to the cylinder gimbal pivot axis.

45. The machine as claimed in claim 34 wherein said reciprocator gimbal pivot axis is normal to a plane within which the crank axis lies.

46. The machine as claimed in claim 34 wherein the crank axis lies in a plane to which the reciprocator gimbal pivot axis is normal to and within which point T1 lies.

47. The machine as claimed in claim 34 wherein a line perpendicular to the said reciprocator gimbal pivot axis and passing through point T1, projects to intersect with the said crank axis at a point R.

48. The machine as claimed in claim 47 wherein said reciprocator gimbal pivot axis is offset from said crank axis yet said crank axis lies in a plane normal to the reciprocator gimbal pivot axis.

49. The machine as claimed in claim 47 wherein said point R is at identical respective distances from point X and point T1 as is point C, the orientations of the pivot axes of the two gimbal arms being mutual reflections in the medial plane M resulting in the point T always on the medial plane M as the crankshaft rotates with respect to the cylinder cluster, and thus ensuring homo-kinetic rotational restraint between said reciprocator and said cylinder cluster.

50. The machine as claimed in claim 34 wherein for each cylinder gimbal arm, said cylinder gimbal arm hinge axis is proximal more the crankshaft axis than it is to point T1.

51. The machine as claimed in claim 34 wherein said reciprocating axis of each said cylinder is parallel to the crankshaft axis and said cylinder cluster includes three or more cylinders.

52. The machine as claimed in claim 34 wherein three or more cylinders are provided that are identical and equally spaced about said crankshaft axis.

53. The machine as claimed in claim 34 wherein said mechanical engagement of said reciprocator with each piston is provided by a connection rod as an extension from or part of said reciprocator and each said connection rod linking said reciprocator and said piston have two or more rotational degrees of freedom and no translational degrees of freedom and offer sufficient degrees of freedom to allow transfer of the linear reciprocating motion of the pistons relative to a respective cylinder to the oscillating motion of the reciprocator and visa versa.

54. The machine as claimed in claim 34 wherein said reciprocator is mounted to rotate about said crank journal on two reciprocator bearings that are axially spaced along said crank journal.

55. The machine as claimed in claim 54 wherein said reciprocator bearing closest to said cylinder cluster is closer to point X than is the reciprocator bearing most distal to the cylinder cluster.

56. The machine as claimed in claim 34 wherein each said rotation restrainer is identical.

57. The machine as claimed in claim 34 wherein said reciprocator connects to said pistons via connection rods extending intermediate to said reciprocator and said pistons, said rotation restrainers number equal to the number of cylinders of said cylinder cluster and are mounted in the spaces between adjacent connection rods.

58. The machine as claimed in claim 34 wherein said gimbal arm tip link of each gimbal arm pair is a spherical bearing.

59. The machine as claimed in claim 34 wherein each said gimbal arm tip link is comprised of three non-parallel single rotation degree of freedom pivot joints whose axes of rotation intersect at point T1.

60. The machine as claimed in claim 59 wherein the first of the three said single rotational degree of freedom pivot joints in each said gimbal arm pair is perpendicular to and intersects the reciprocator gimbal arm hinge axis, and the second of the three said single rotational degree of freedom pivot joints in each said gimbal arm pair is perpendicular to and intersects or closely approaches the cylinder gimbal arm hinge axis, and the third of the said single rotational degree of freedom pivot joints in each said gimbal arm pair is mutually perpendicular to the other two rotational degree of freedom pivot joints.

61. The machine as claimed in claim 59 wherein the first of the three said single rotational degree of freedom pivot joints is perpendicular to and intersects the reciprocator gimbal arm hinge axis and is comprised of two axially separate radial bearings and a bi-directional thrust bearing, and the second of the three said single rotational degree of freedom pivot joints is perpendicular to and intersects or closely approaches the cylinder gimbal arm hinge axis and is comprised of two axially separate radial bearings and a bi-directional thrust bearing, and the third of the said single rotational degree of freedom pivot joints is mutually perpendicular to the other two rotational degree of freedom pivot joints and is comprised of a one or more radial bearings and a bi-directional thrust bearing.

62. The machine as claimed in claims 61 wherein one or more of the thrust bearings and/or the radial bearings of said single rotational degree of freedom pivot joints and/or gimbal arm hinge axis pivots incorporates intermediate bearing elements that rotate with respect to both gimbal arm components that the said bearing/s link together.

63. The machine as claimed in claim 34 wherein said cylinder cluster is mounted to rotate with respect to a stationary frame of reference about said crankshaft axis and valving of each valved inlet/outlet port is controlled by a ported member relative to which cylinder cluster rotates to bring said inlet/outlet ports into sequential association with ports of an otherwise valved inlet/outlet port sealing facilitating ported member, in order to enable the fluid transfer to and from the cylinders of the cylinder cluster corresponding to the appropriate location of the pistons in their movement between TDC and BDC.

64. The machine as claimed in claim 63 wherein an indexing drive is provided acting intermediate of said cylinder cluster and said ported member in order to index the rotation of the cylinder cluster relative the ported member.

65. The machine as claimed in claim 63 wherein said rotation restrainer acts between said cylinder cluster and said reciprocator so that they rotate at the same angular rate with respect to said crankshaft and crank journal respectively and relative said ported member.

66. The machine as claimed in claim 34 wherein each rotation restrainer acts between said cylinder cluster and said reciprocator to restrain their relative rotation with respect to said crankshaft and crank journal respectively.

67. A reciprocator restraint assembly of or for a Z-crank axial piston machine that includes a crankshaft rotatable about a crankshaft axis and carrying a crank journal having an inclined crank axis that is oblique to the crankshaft axis but aligned to intersect therewith at an acute angle A at a point X on the crankshaft, said assembly to restrain the relative rotation between a cylinder cluster body and a reciprocator said assembly comprising:

two gimbal arms, said gimbal arms linked together by a gimbal link joint with multiple rotational degrees of freedom and that intersect at a point T, point T lying in a medial plane M being defined as the plane passing through point X to which the line that bisects angle A is normal, wherein each of said gimbal arms is pivotally mounted at an identical distance L from point T, one of said gimbal arms, hereinafter referred to as the "cylinder gimbal", being pivotally mounted from said cylinder cluster about a cylinder gimbal pivot axis, the second of said gimbal arms, hereinafter referred to as the "reciprocator gimbal" being pivotally mounted from said reciprocator about a reciprocator gimbal pivot axis, said reciprocator gimbal pivot axis positioned equidistant from point X and point T as is the cylinder gimbal pivot axis, the orientations of the pivot axes of the two gimbal arms being mutual reflections in the medial plane M resulting in the point T lying on the medial plane M as the crankshaft rotates with respect to the cylinder cluster, and thus ensuring homo-kinetic rotational restraint between said reciprocator and said cylinder cluster.

68. The assembly as claimed in claim 65 wherein said cylinder gimbal pivot axis is normal to a plane within which the crankshaft axis lies.

69. The assembly as claimed in claim 65 wherein the crankshaft axis lies in a plane to which the cylinder gimbal pivot axis is normal to and within which point T lies.

70. The assembly as claimed in claim 65 wherein a line perpendicular to the said cylinder gimbal pivot axis and passing through point T, intersects or projects to intersect with the said crankshaft axis at a point C.

71. The assembly as claimed in claim 68 wherein point C lies on the crankshaft axis.

72. The assembly as claimed in claim 1 wherein said cylinder gimbal pivot axis is perpendicular to said crankshaft axis.

73. The assembly as claimed in claim 10 wherein said reciprocator gimbal pivot axis is normal to a plane within which the crank axis lies.

74. The machine as claimed in claim 73 wherein the point R lies on the crank axis.

75. The machine as claimed in 74 wherein said reciprocator gimbal pivot axis is offset from said crank axis yet said crank axis lies in a plane normal to the reciprocator gimbal pivot axis.

76. The machine as claimed in claim 74 wherein said point R is at identical respective distances from point X and point T as is point C, the orientations of the pivot axes of the two gimbal arms being mutual reflections in the medial plane M resulting in the point T always on the medial plane M as the crankshaft rotates with respect to the cylinder cluster, and thus ensuring homo-kinetic rotational restraint between said reciprocator and said cylinder cluster.

77. The machine as claimed in claim 1 wherein the cylinder cluster has an odd number of cylinders.

78. The machine as claimed in claim 1 wherein the machine is an internal combustion engine.

79. An axial piston machine acting as a thermodynamic engine, compressor, motor or pump comprising;

a crankshaft rotatable about a crankshaft axis and carrying an crank journal having an inclined crank axis that is oblique to the crankshaft axis but aligned to intersect therewith at an acute angle A at point X, a cylinder cluster comprising at least two cylinders rigidly located with respect to each other, each cylinder containing a complementary piston to each reciprocate along a reciprocating axis defined by its respective cylinder and each of a cross section matched to the cross section of the cylinder, each said cylinder in fluid connection with at least one valved inlet/outlet port therefor, a reciprocator mounted to rotate relative to said crank journal about said inclined crank axis, said reciprocator in mechanical engagement with each piston to allow the requisite reciprocating displacement of each piston within its respective cylinder between top dead centre (TDC) and bottom dead centre (BDC) upon the crankshaft rotating relative to said cylinder cluster about the said crankshaft axis, at least two rotation restrainers to restrain the relative rotation between said cylinder cluster body and said reciprocator about the crankshaft axis, each of said rotation restrainers being comprised of a pair of gimbal arms linking between the reciprocator and cylinder cluster, a first of said gimbals arms herein after "a cylinder gimbal arm" pivotably connected to said cylinder cluster and pivotable thereto about a cylinder gimbal hinge axis that is normal to a plane in which the crankshaft axis lies and that is set a distance from the crankshaft axis on a side thereof so that said cylinder gimbal arm projects, from said cylinder gimbal hinge axis, away from said crankshaft a second of said arms (herein after "reciprocator gimbal arm") pivotably connected to said reciprocator and pivotable thereto about a reciprocator gimbal hinge axis that is normal to a plane in which the crank axis lies and that is set a distance from the crank axis on a side thereof so that said reciprocator gimbal arm projects, from said reciprocator gimbal hinge axis, away from said crank, the reciprocator gimbal arm and cylinder gimbal arm of each said pair linked together by a gimbal arm tip link having three rotational degrees of freedom that intersect at a point T1 that is equidistant from their respective gimbal arm hinge axes and always lying on a medial plane defined as the plane passing through point X to which the line that bisects angle A is normal, the orientations of the hinge axes for each pair of gimbal arms being mutual reflections in the medial plane so that as the crankshaft rotates with respect to the cylinder cluster homo-kinetic restraint of said reciprocator is ensured.

80. The machine as claimed in claim 79 wherein the cylinder arm hinge axis is defined by two spaced apart cylinder arm hinges that are coaxial and are located on each side of a plane within which both T1 and said crankshaft axis lie.

81. The machine as claimed in claim 79 wherein the reciprocator arm hinge axis is defined by two spaced apart cylinder arm hinges that are coaxial other and are located on each side of a plane within which both T1 and said crank axis lie.

82. A Z-crank axial piston internal combustion engine comprising a cylinder cluster of at least two piston containing cylinders rigidly located with respect to each other, each said cylinder including at least one working fluid transfer port, a crankshaft rotatable relative to said cylinder cluster and carrying an angled crank about which a reciprocator can rotate that is in mechanical connection with the pistons, said angled crank having a crank axis that is oblique to the crankshaft axis but aligned to intersect therewith at an acute angle A at a point X on the crankshaft, and a ported member relative to which the cylinder cluster can rotate and that can seal the at least one fluid transfer port of each cylinder yet offers, at intervals, their exposure to spark plug(s) and/or working fluid delivery and removal facilities, an indexing drive to transmit rotation between said cylinder cluster and said crank shaft to, in use, rotate said cylinder cluster relative said ported member about said crankshaft axis at a rotational rate timed to coincide with the desired range of movement of the piston in each cylinder between TDC and BDC, and two gimbal arms, said gimbal arms linked together by a gimbal link joint with multiple rotational degrees of freedom and that intersect at a point T, point T lying in a medial plane M being defined as the plane passing through point X to which the line that bisects angle A is normal, wherein each of said gimbal arms is pivotally mounted at an identical distance L from point T, one of said gimbal arms, hereinafter referred to as the "cylinder gimbal", being pivotally mounted from said cylinder cluster about a cylinder gimbal pivot axis, the second of said gimbal arms, hereinafter referred to as the "reciprocator gimbal" being pivotally mounted from said reciprocator about a reciprocator gimbal pivot axis, said reciprocator gimbal pivot axis positioned equidistant from point X and point T as is the cylinder gimbal pivot axis, the orientations of the pivot axes of the two gimbal arms being mutual reflections in the medial plane M resulting in the point T lying on the medial plane M as the crankshaft rotates with respect to the cylinder cluster, and thus ensuring homo-kinetic rotational restraint between said reciprocator and said cylinder cluster.

* * * * *

UNITED STATES PATENT AND TRADEMARK OFFICE

CERTIFICATE OF CORRECTION

PATENT NO. : 8,689,674 B2
APPLICATION NO. : 12/733133
DATED : April 8, 2014
INVENTOR(S) : Duke et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1061 days.

Signed and Sealed this
Twenty-ninth Day of September, 2015

Michelle K. Lee

Michelle K. Lee
*Director of the United States Patent and Trademark Office*